US009609710B2

(12) United States Patent
Ido et al.

(10) Patent No.: US 9,609,710 B2
(45) Date of Patent: Mar. 28, 2017

(54) LIGHTING DEVICE, ILLUMINATION DEVICE, AND LIGHTING FIXTURE

(71) Applicant: Panasonic Intellectual Property Management Co., Ltd., Osaka (JP)

(72) Inventors: Shigeru Ido, Osaka (JP); Hiroshi Kido, Osaka (JP); Akinori Hiramatu, Nara (JP); Daisuke Ueda, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 14/796,249

(22) Filed: Jul. 10, 2015

(65) Prior Publication Data

US 2016/0029447 A1 Jan. 28, 2016

(30) Foreign Application Priority Data

Jul. 24, 2014 (JP) ..... 2014-150949
Feb. 2, 2015 (JP) ..... 2015-018897

(51) Int. Cl.
*H05B 33/08* (2006.01)

(52) U.S. Cl.
CPC ..... *H05B 33/083* (2013.01)

(58) Field of Classification Search
None
See application file for complete search history.

(56) References Cited

U.S. PATENT DOCUMENTS 3,637,974 A * 1/1972 Tajbl ..... H05H 1/36 219/130.4
4,095,740 A * 6/1978 Wirth ..... G05D 23/275 236/47
4,571,531 A * 2/1986 Lin ..... H02J 7/008 307/66
5,602,521 A * 2/1997 Takahashi ..... H05B 33/08 340/326
5,604,408 A * 2/1997 Hamm ..... H05B 41/2985 315/307
5,612,609 A * 3/1997 Choi ..... H02M 1/4225 323/210
5,642,065 A * 6/1997 Choi ..... H02M 3/33507 327/110
5,962,981 A * 10/1999 Okude ..... H05B 41/042 315/128
5,994,843 A * 11/1999 Kataoka ..... H05B 41/28 315/106
6,049,472 A * 4/2000 Suzuki ..... H02M 1/425 363/37

(Continued)

FOREIGN PATENT DOCUMENTS

JP 2006-147933 A 6/2006
JP 2012-009271 A 1/2012

(Continued)

*Primary Examiner* — Crystal L Hammond
(74) *Attorney, Agent, or Firm* — Renner, Otto, Boisselle & Sklar, LLP.

(57) ABSTRACT

A lighting device is configured such that only one of a first current control circuit and a charging current control circuit operates in any of operation modes from a first mode to a fourth mode. The lighting device is configured such that the first current control circuit and the charging current control circuit are not included in the same closed circuit.

14 Claims, 20 Drawing Sheets

(56) References Cited

U.S. PATENT DOCUMENTS

| | | | | |
|---|---|---|---|---|
| 6,066,925 | A * | 5/2000 | Lehmann | H05B 39/09 315/200 A |
| 6,118,224 | A * | 9/2000 | Murakami | H05B 41/28 315/171 |
| 7,911,149 | B2 * | 3/2011 | Schaible | H05B 33/0815 315/224 |
| 8,773,045 | B1 * | 7/2014 | Cheng | H05B 33/0815 315/211 |
| 8,779,677 | B2 * | 7/2014 | Trattler | H05B 33/0815 315/227 R |
| 9,173,261 | B2 * | 10/2015 | Mokry | H05B 33/0815 |
| 2009/0195165 | A1 * | 8/2009 | Yang | H05B 33/0827 315/152 |
| 2012/0025722 | A1 * | 2/2012 | Mokry | H05B 33/0827 315/187 |
| 2012/0068616 | A1 | 3/2012 | Akiyama et al. | |
| 2012/0120700 | A1 * | 5/2012 | Elberbaum | H02M 7/2176 363/128 |
| 2012/0299495 | A1 | 11/2012 | Sakuragi et al. | |
| 2013/0307415 | A1 * | 11/2013 | Ni | H05B 33/0812 315/122 |

FOREIGN PATENT DOCUMENTS

| | | | |
|---|---|---|---|
| JP | 2012-89827 | A | 5/2012 |
| JP | 2012-244137 | A | 12/2012 |
| JP | 2013-161937 | A | 8/2013 |

* cited by examiner

Iin
10
3
2A
If1
α
11
IM1
13
If2
2B
IM2
D2
D1
D4
12
CO
VCO
IM3
D3

10
3
2A
11
β
13
2B
D2
D1
D4
12
CO
D3

10
3
2A
11
γ
13
2B
D2
D1
D4
12
CO
D3

10
3
2A
δ
11
13
2B
D2
D1
D4
12
CO
D3

LIGHTING DEVICE, ILLUMINATION DEVICE, AND LIGHTING FIXTURE

CROSS-REFERENCE TO RELATED APPLICATIONS

The application is based upon and claims the benefit of priority of Japanese Patent Application No. 2014-150949, filed on Jul. 24, 2014, and Japanese Patent Application No. 2015-018897, filed on Feb. 2, 2015, the entire contents of which are incorporated herein by reference.

TECHNICAL FIELD

This disclosure relates to lighting devices, illumination devices and lighting fixtures and, more particularly, to a lighting device configured to light a solid-state light-emitting element, an illumination device including the lighting device and a light source including a solid-state light-emitting element, and a lighting fixture including the illumination device.

BACKGROUND ART

A light-emitting diode driving device described in JP 2012-244137A (hereinafter referred to as Document 1) is illustrated as a conventional example of a lighting device. The light-emitting diode driving device (hereinafter referred to as a conventional example) includes a rectifier circuit, an LED unit, a constant current circuit for charging a capacitor (charging circuit), a constant current circuit for discharging a capacitor (discharging circuit), a charging diode, a discharging diode, a charging-discharging capacitor, and the like. The conventional example is, for example, electrically connected to an AC power supply with an effective value of 100 V, and is configured to rectify an AC voltage of the AC power supply with a rectifier circuit, and to obtain a pulsating voltage with a peak value of approximately 141 V.

A first end of the charging-discharging capacitor and a first end of the discharging circuit are electrically connected to a high potential-side output terminal of the rectifier circuit, and a low potential-side output terminal thereof is electrically connected to ground. An anode of the charging diode and a cathode of the discharging diode are electrically connected to a second end of the charging-discharging capacitor. A cathode of the charging diode is electrically connected to a second end of the discharging circuit and an anode-side terminal of the LED unit. A cathode of the LED unit is electrically connected to an anode of the discharging diode and a first end of the charging circuit. A second end of the charging circuit is electrically connected to ground.

Next, operations of this conventional example will be described.

First, charging of the charging-discharging capacitor is performed for a period during which a power supply voltage of the AC power supply is high. A charging current flows in a path (hereinafter referred to as a charging path) that passes from the rectifier circuit through the charging-discharging capacitor, the charging diode, the LED unit, and the charging circuit in this order, and charges the charging-discharging capacitor. Note that the charging current is controlled to a constant current by the charging circuit. At this time, the LED unit and the charging-discharging capacitor are connected in series, and loss in the charging circuit can be mitigated due to a charged voltage of the charging-discharging capacitor, even if a forward voltage of the LED unit is small and a voltage difference thereof to the power supply voltage is large. Also, the charged voltage of the charging-discharging capacitor is a voltage obtained by subtracting the forward voltage of the LED unit from the power supply voltage at the end of charging. When the charging ends, the current flowing in the charging circuit decreases rapidly, and the discharging circuit starts operation in response to a signal generated when this rapid decrease is detected.

Discharging of the charging-discharging capacitor is performed for a period during which the power supply voltage of the AC power supply is low. The discharge current flows in a path (hereinafter referred to as a discharging path) that passes from the charging-discharging capacitor through the discharging circuit, the LED unit, the discharging diode, and the charging-discharging capacitor in this order. Note that the discharge current is controlled to a constant current by the discharging circuit.

Here, a period during which the power supply voltage is higher than the voltage (charged voltage) across the charging-discharging capacitor exists before transitioning from the charging period to the discharging period, and a current flows in the period (hereinafter referred to as a transient period) in a path (hereinafter referred to as a transient path) that passes from the rectifier circuit through the discharging circuit, the LED unit, and the charging circuit in this order. Note that the current (hereinafter referred to as a transient current) is controlled to a constant current having a current value that is equal to the value of whichever current is smaller between the current in the discharging circuit and the current in the charging circuit (current in the discharging circuit, for example).

According to the conventional example, as described above, the LED unit can be directly driven (lighted) by the pulsating voltage that results from rectification by the rectifier circuit, without the AC electric power supplied from the AC power supply being converted to DC electric power. Moreover, in this conventional example, lighting of the LED unit and charging of the charging-discharging capacitor are performed at the same time by connecting the LED unit and the charging-discharging capacitor in series, for a period during which the pulsating voltage is high, and the LED unit can be lighted by discharging the charging-discharging capacitor for a period during which the pulsating voltage is low. As a result, since there is no period during which the light source (LED unit) is turned off in one cycle of the power supply voltage, flickering can be suppressed.

Incidentally, in the conventional example described in Document 1, there is a problem in that efficiency decreases since the transient current in the transient period flows in both the charging circuit and the discharging circuit, and loss occurs in each of the charging circuit and the discharging circuit.

SUMMARY

The present technology has been made in view of the above-described problems, and an object of the present invention is to improve efficiency compared with the conventional example.

A lighting device according to an aspect of the present invention includes a rectifier circuit, a current control circuit, a storage element, a charging current control circuit, a first rectifier element, a second rectifier element, and a third rectifier element. The rectifier circuit is configured to rectify a sine wave AC voltage inputted between a pair of input terminals of the rectifier circuit, and output a pulsating voltage from between a pair of output terminals of the rectifier circuit. The current control circuit is electrically connected in series to a light source between the pair of output terminals, and configured to control a current flowing in the light source such that the current does not exceed a predetermined value. The charging current control circuit is configured to control a charging current that flows to the storage element. The storage element is electrically connected in series to the charging current control circuit between two ends of the current control circuit. The first rectifier element is for causing the charging current to flow to the storage element via the light source and not via the current control circuit. The second rectifier element is for causing a discharge current that is discharged from the storage element to flow in the light source. The third rectifier element is for causing the discharge current to flow bypassing the charging current control circuit.

An illumination device according to an aspect of the present invention includes one or more light sources and the lighting device, and the one or more light sources include one or more solid-state light-emitting elements.

A lighting fixture according to an aspect of the present invention includes the illumination device and a fixture body that holds the illumination device.

The lighting device, the illumination device, and the lighting fixture have an effect of enabling efficiency to be improved compared with conventional technology.

BRIEF DESCRIPTION OF THE DRAWINGS

The figures depict one or more implementations in accordance with the present teaching, by way of example only, not by way of limitations. In the figures, like reference numerals refer to the same or similar elements.

DETAILED DESCRIPTION (Embodiment 1)

Figure 1:
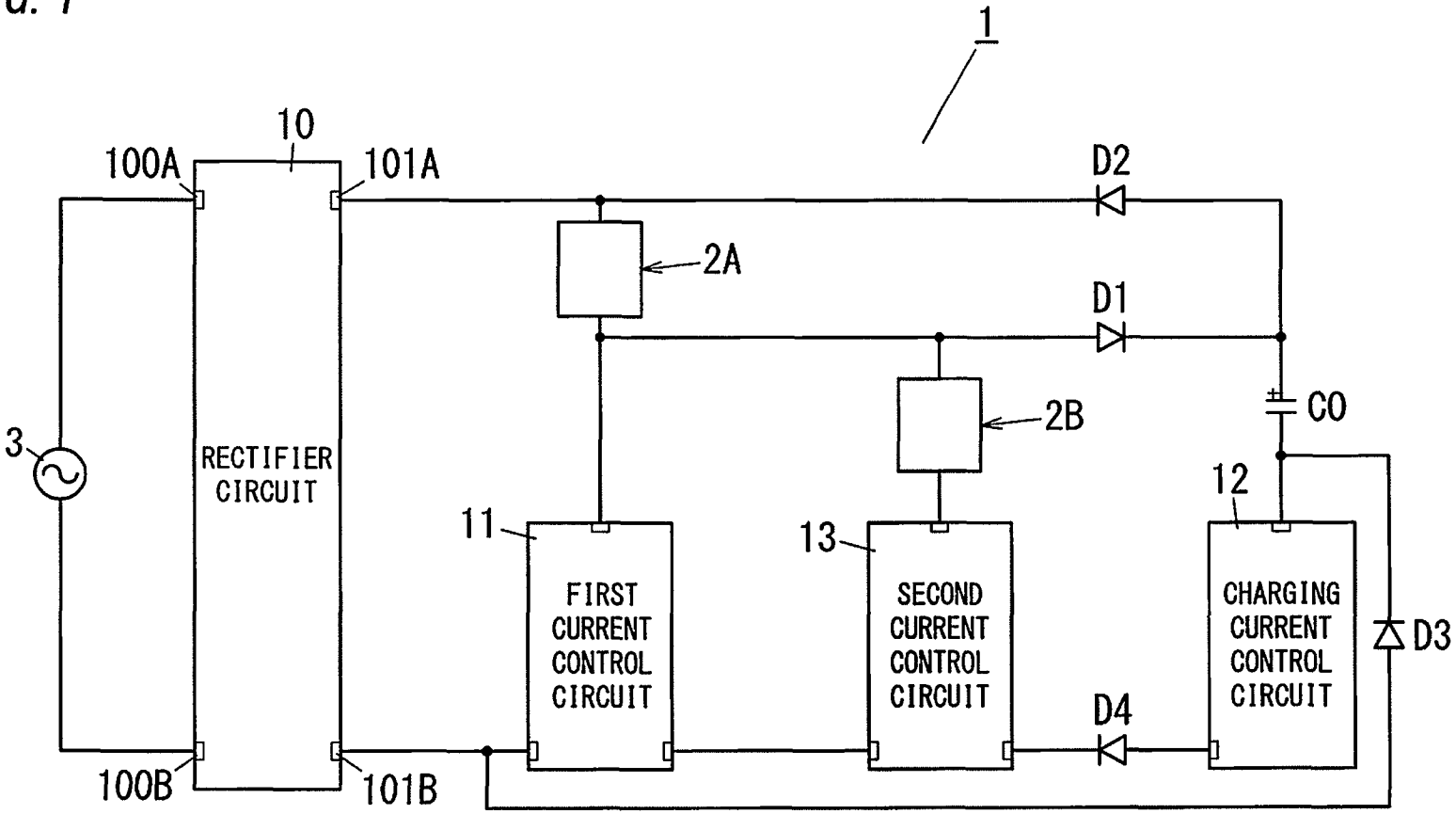
FIG. 1 is a block diagram illustrating a lighting device and an illumination device according to Embodiment 1.
Figure 2A:
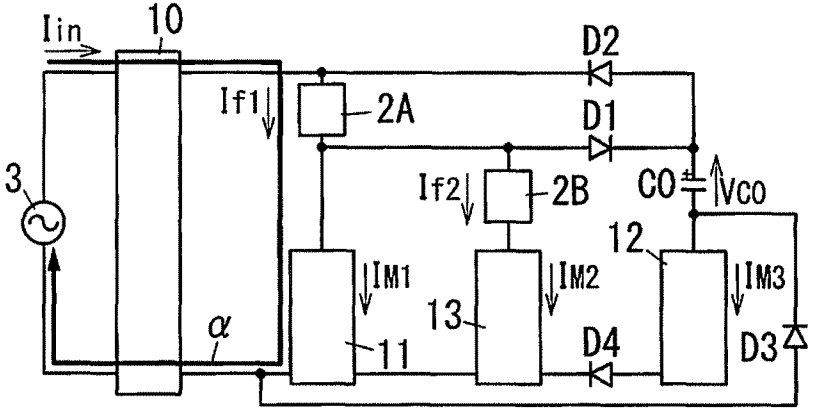
FIGS. 2A to 2D are block diagrams for describing operations of the lighting device and the illumination device according to Embodiment 1.
Figure 2B:
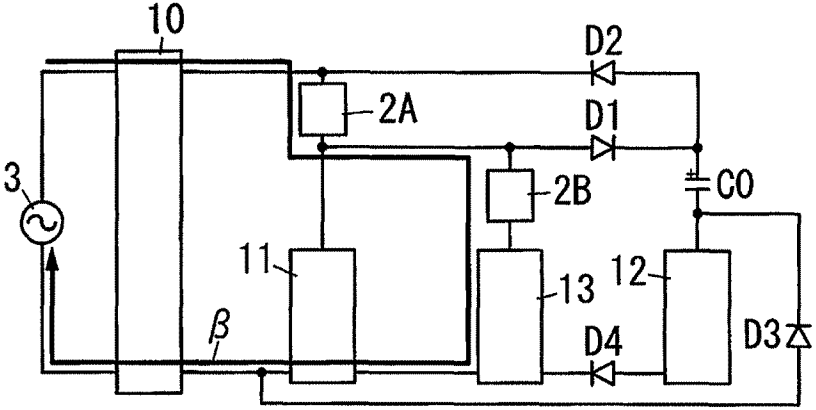
Figure 2C:
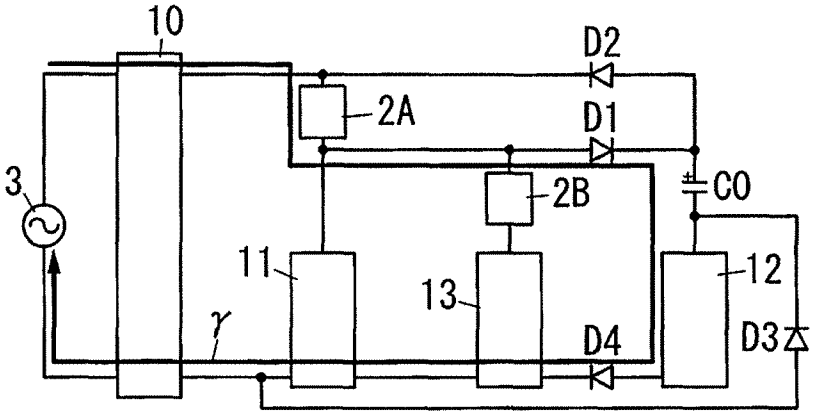
Figure 2D:
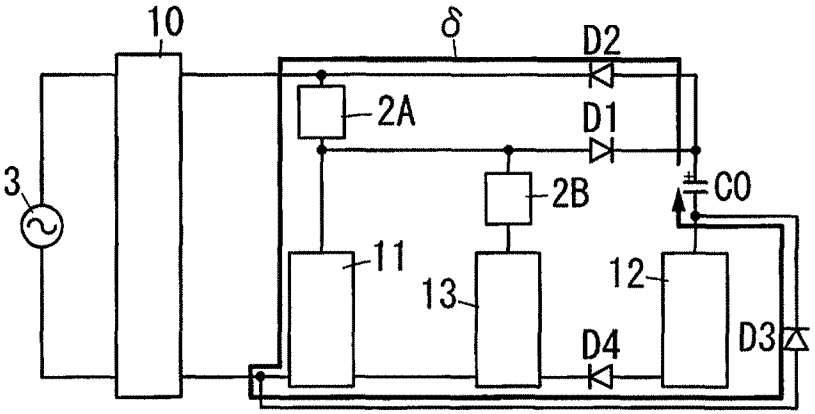

An illumination device according to the present embodiment includes a lighting device 1 and a light source (first light source portion 2A), as shown in FIG. 1. Also, the illumination device preferably includes a second light source portion 2B.

The lighting device 1 includes a rectifier circuit 10, a current control circuit (first current control circuit 11), a storage element C0, a charging current control circuit 12, a first rectifier element D1, a second rectifier element D2, and a third rectifier element D3. Furthermore, the lighting device 1 preferably includes a second current control circuit 13 and a fourth rectifier element D4. Note that, although each of the first to fourth rectifier elements D1 to D4 is constituted by a diode in the present embodiment, the rectifier element is not limited to a diode.

Figure 3:
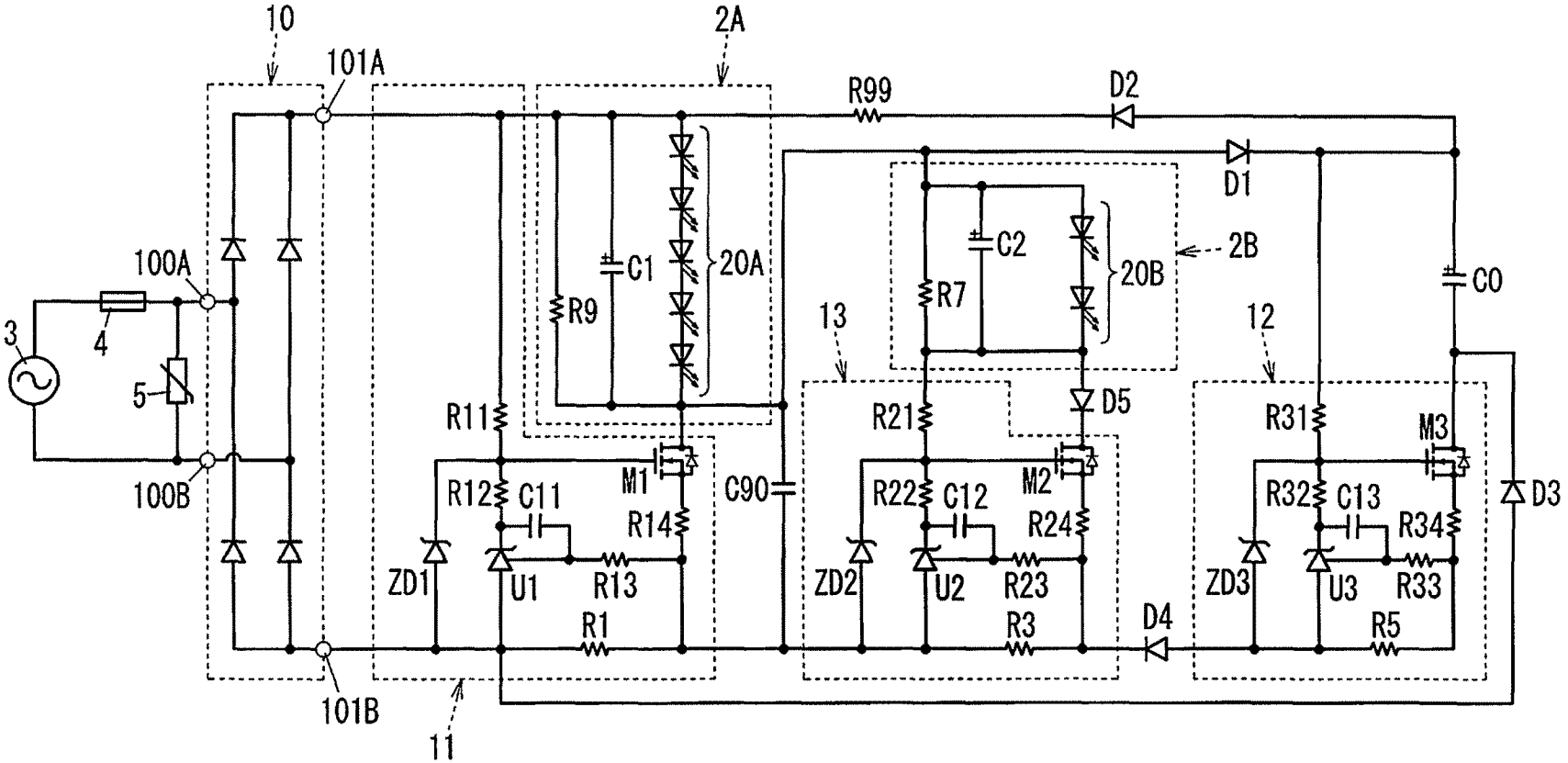
FIG. 3 is a circuit configuration diagram of the lighting device and the illumination device according to Embodiment 1.

The rectifier circuit 10 is constituted by a diode bridge, as shown in FIG. 3, and includes a pair of input terminals 100A and 100B and a pair of output terminals 101A and 101B. An AC power supply 3 is electrically connected between the pair of input terminals 100A and 100B. Note that a fuse 4 may be inserted between the input terminal 100A of the rectifier circuit 10 and the AC power supply 3, as shown in FIG. 3. Also, it is preferable that a surge absorbing element 5 such as a varistor is electrically connected between the input terminals 100A and 100B of the rectifier circuit 10.

The AC power supply 3 supplies a sine wave AC voltage having an effective value of 100 V, for example. Accordingly, a sine wave pulsating voltage having a maximum value (peak value) of $100\times\sqrt{2}\approx 141$ V is outputted from the output terminals 101A and 101B of the rectifier circuit 10. Note that the rectifier circuit 10 is preferably configured such that one output terminal 101A is at a higher potential than the other output terminal 101B.

As shown in FIG. 3, the first light source portion 2A includes a series circuit of a plurality of (only five are illustrated) LEDs 20A and a smoothing capacitor C1 and a resistor R9 that are connected in parallel to the series circuit.

The first light source portion 2A includes two terminals, namely a positive electrode and a negative electrode, and is configured to emit light (to be lighted) due to current flowing in the LEDs 20A when the potential of the positive electrode relative to the negative electrode is a reference voltage or more. Note that the reference voltage is equal to the total sum of forward voltages of the LEDs 20A that constitutes the series circuit. It is preferable that, in the present embodiment, the reference voltage Vf1 of the first light source portion 2A is set to less than or equal to half the maximum value of the pulsating voltage, and is 60 V, for example. That is to say, the first light source portion 2A includes a series circuit of n (n is a natural number) LEDs 20A, where n is a maximum number that satisfies the following relationship: forward voltage of one LED 20A×n≤60 V.

The smoothing capacitor C1 stabilizes (smoothes) the current that flows in the series circuit of LEDs 20A. A current If1 flows in the first light source portion 2A for an entire period of one cycle (a period equal to a half cycle of the power supply voltage of the AC power supply 3; the same applies hereinafter) of the pulsating voltage, as described later. Accordingly, a small value of approximately 0.1 μF (microfarad), for example, may suffice for the capacitance of the smoothing capacitor C1. Note that in the case where the first light source portion 2A is subjected to phase control light modulation, the capacitance of the smoothing capacitor C1 is preferably set to a relatively large value (about 100 μF, for example). For example, if the average value of the current If1 in the first light source portion 2A is assumed to be 0.1 A (ampere), an equivalent resistor of the first light source portion 2A is RL1=Vf1/If1=60/0.1=600Ω (ohm). Therefore, a time constant τ1 (=C1×RL1) of a RC circuit constituted by the equivalent resistor RL1 and the smoothing capacitor C1 is preferably longer than one cycle (=1/50=0.02 seconds) of the power supply voltage, and is preferably τ1=0.02 seconds×3=60 milliseconds, for example. The capacitance of the smoothing capacitor C1 that satisfy the condition is 100 μF.

Note that, considering various external surge voltages applied to the lighting device 1, it is preferable that a capacitor is electrically connected in parallel to each LED 20A, in addition to the smoothing capacitor C1 connected in parallel to the series circuit of the LEDs 20A. Also, a plurality of smoothing capacitors that are electrically connected in parallel to respective LEDs 20A may be provided in place of the smoothing capacitor C1. For example, if a reference voltage (forward voltage) of the LED 20A is 12 V, it is sufficient that a capacitor having a breakdown voltage of 16V and a capacitance value of 470 μF is electrically connected in parallel to each LED 20A. Alternatively, if the reference voltage of the LED 20A is about 3 V, it is sufficient that an electric double layer capacitor is electrically connected in parallel to each LED 20A, and a small smoothing circuit can be realized.

Also, the second light source portion 2B includes, similarly to the first light source portion 2A, a series circuit of a plurality of (only two are illustrated) LEDs 20B, and a smoothing capacitor C2 and a resistor R7 that are connected in parallel to the series circuit. The second light source portion 2B includes two terminals, namely a positive electrode and a negative electrode, and is configured to emit light (to be lighted) due to current flowing in the LEDs 20B when the potential of the positive electrode relative to the negative electrode is a reference voltage or more. Note that the reference voltage is equal to the total sum of forward voltages of the LEDs 20B that constitute the series circuit. It is preferable that, in the present embodiment, the reference voltage Vf2 of the second light source portion 2B is set to half the reference voltage Vf1 of the first light source portion 2A or less, and is 24 V, for example. That is to say, the second light source portion 2B includes a series circuit of m (m is a natural number) LEDs 20B, where m is a maximum number that satisfies the following relationship: forward voltage of one LED 20B×m≤24 V.

Since a period during which the current If2 flows in the second light source portion 2B is shorter than one cycle of the pulsating voltage, as will be described later, the capacitance of the smoothing capacitor C2 preferably has a larger value than the capacitance of the smoothing capacitor C1. Note that if the light flux of the second light source portion 2B is sufficiently smaller than the light flux of the first light source portion 2A, the smoothing capacitor C2 may have a small capacitance or be omitted. For example, if an average value of the current If2 in the second light source portion 2B is assumed to 0.05 A, an equivalent resistor of the second light source portion 2B is RL2=Vf2/If2=24/0.05=480Ω (ohm). Therefore, the time constant τ2 (=C2×RL2) of a RC circuit constituted by the equivalent resistor RL2 and the smoothing capacitor C2 is preferably longer than the one cycle (=1/50=0.02 seconds) of the power supply voltage, and is preferably greater than or equal to τ1=0.02 seconds×3=60 milliseconds, for example. It is sufficient that the capacitance of the smoothing capacitor C2 is approximately 220 μF in order to satisfy this condition.

Note that it is preferable that, since an afterglow time due to electric charges charged in smoothing capacitors C1 and C2 increases as the time constants τ1 and τ2 become larger, the discharging resistors R9 and R7 are connected in parallel to the respective smoothing capacitors C1 and C2. For example, if the time constant τ2 is assumed to be 3 seconds, the resistance value of the resistor R7 is preferably set to about 3/220 μF≈13.6 kΩ.

On the other hand, the resistor R9 in the first light source portion 2A may be omitted when the value of the capacitance of the smoothing capacitor C1 is relatively small. Note that, in the case where a wall switch having a position display light is connected between the lighting device 1 of the present embodiment and the AC power supply 3, there is a minute flow of current and the position display light is lighted, even when the wall switch is in an off state. In order to avoid the first light source portion 2A being lighted due to the minute current, the resistor R9 is desirably electrically connected in parallel to the series circuit of the LEDs 20A. For example, when the magnitude of the minute current is 1 mA, the voltage drop in the resistor R9 is desirably equal to or less than half of the reference voltage Vf1 in order to not light the first light source portion 2A. That is, the resistance value of the resistor R9 is preferably set to (60 V/2)/1 mA=30 kΩ.

The first current control circuit 11 is configured by a constant current circuit using a transistor M1 and a shunt regulator U1 (refer to FIG. 3). The transistor M1 is constituted by an n-channel MOSFET (metal-oxide-semiconductor field-effect transistor), for example. However, the transistor M1 may be constituted by a pnp-type bipolar transistor.

A drain of the transistor M1 is electrically connected to the negative electrode of the first light source portion 2A, and a source of the transistor M1 is electrically connected to a series circuit of a resistor R14 and a resistor R1. Also, a gate of the transistor M1 is electrically connected to a connection point of two resistors R11 and R12 that constitute a series circuit. A cathode of the shunt regulator U1 is electrically connected to a first end of the resistor R12 and a first end of a capacitor C11, and an anode of the shunt regulator U1 is electrically connected to a first end of the resistor R1 and the output terminal 101B of the rectifier circuit 10. Also, a reference terminal of the shunt regulator U1 is electrically connected to a second end of the capacitor C11 and a first end of a resistor R13.

The resistor R11 is a resistor for biasing the gate of the transistor M1. Since the first end of the resistor R11 is electrically connected to the positive electrode of the first light source portion 2A, the gate voltage of the transistor M1 is always pulled up to a voltage that is higher than the drain voltage, and a period during which current flows in the first light source portion 2A can be lengthened. Note that it is preferable that, in order to reduce loss in the resistor R11, the first end of the resistor R11 is electrically connected to an anode of the LED 20A whose cathode is electrically connected to the negative electrode of the first light source portion 2A, among the LEDs 20A connected in series.

Furthermore, a second end of the resistor R13 is electrically connected to a connection point of the resistor R1 and the resistor R14. Note that the resistors R12, R13, and R14, and the capacitor C11 constitutes a filter circuit for setting a response characteristic of the shunt regulator U1.

The first current control circuit 11 controls (to be constant current) a drain current of the transistor M1 by increasing or decreasing a cathode current (gate voltage) such that a voltage (voltage drop) generated across the resistor R1 matches a reference voltage of the shunt regulator U1. The reference voltage of the shunt regulator U1 is 1.24 V, for example. If a resistance value of the resistor R1 is 10Ω, the shunt regulator U1 controls the transistor M1 such that a current (=0.124 A) flows that causes the voltage across the resistor R1 to be 1.24 V.

Here, since an output current (drain current of the transistor M1; the same applies hereinafter) of the first current control circuit 11 tends to be unstable due to an effect of the smoothing capacitor C2, which is a capacitive load, the output current is stabilized and oscillation is suppressed by the filter circuit. Specifically, the resistor R14 that is inserted between the source of the transistor M1 and the resistor R1 can contribute to stabilize the output current, when the threshold voltage at which the transistor M1 turns on is a low voltage of several volts. Note that although the filter circuit is configured as a low-pass filter circuit, a low-pass filter circuit and a high-pass filter circuit may be combined.

Also, a zener diode ZD1 is electrically connected between the gate of the transistor M1 and the output terminal 101B of the rectifier circuit 10. With this zener diode ZD1, the voltage between the gate and source of the transistor M1 is restricted, and the shunt regulator U1 is protected such that the voltage between the cathode and anode thereof does not exceed a maximum rated voltage.

The second current control circuit 13 is constituted by, similarly to the first current control circuit 11, a constant current circuit using a transistor M2 and a shunt regulator U2 (refer to FIG. 3). Note that the circuit configuration of the second current control circuit 13 is in common with that of the first current control circuit 11, except that the reference signs added to respective elements are different. Therefore, detailed description of the second current control circuit 13 will be omitted.

Also, the charging current control circuit 12 is constituted by, similarly to the first current control circuit 11, a constant current circuit using a transistor M3 and a shunt regulator U3 (refer to FIG. 3). Note that the circuit configuration of the charging current control circuit 12 is in common with that of the first current control circuit 11, except that the reference signs added to respective elements are different. Therefore, detailed description of the charging current control circuit 12 will be omitted.

A series circuit of the first light source portion 2A and the first current control circuit 11 is electrically connected between the output terminals 101A and 101B of the rectifier circuit 10. Also, a series circuit of the second light source portion 2B and the second current control circuit 13 is electrically connected in parallel to the first current control circuit 11. Note that a fifth rectifier element D5 is preferably inserted between the second light source portion 2B and the second current control circuit 13, while the anode thereof being on the second light source portion 2B side. Note that a capacitor C90 is preferably electrically connected in parallel to the first current control circuit 11 in order to prevent circuit failure due to an external surge voltage.

The fifth rectifier element D5 is provided to prevent charges accumulated in the smoothing capacitor C2 of the second light source portion 2B from being discharged via a parasitic diode of the transistor M2. That is, when the voltage between the source and drain of the transistor M2 is less than the voltage across the smoothing capacitor C2, electric charges charged in the smoothing capacitor C2 may be discharged through the transistor M1, the resistor R3, and a parasitic diode of the transistor M2 in this order. Therefore, in the case where a MOSFET is used as the transistor M2, the fifth rectifier element D5 is preferably inserted somewhere in the discharging path.

Furthermore, a series circuit of a storage element (capacitor C0), the charging current control circuit 12, and the fourth rectifier element D4 is electrically connected in parallel to the first current control circuit 11 via the first rectifier element D1. That is, a resistor R5 of the charging current control circuit 12, the fourth rectifier element D4, the resistor R3 of the second current control circuit 13, and the resistor R1 of the first current control circuit 11 are electrically connected in series to the output terminal 101B of the rectifier circuit 10.

Also, an anode of the second rectifier element D2 is electrically connected to a connection point of the first rectifier element D1 (cathode thereof) and a capacitor C0, and a cathode of the second rectifier element D2 is electrically connected to the output terminal 101A of the rectifier circuit 10 via a resistor R99. Furthermore, a connection point of the capacitor C0 and the charging current control circuit 12 is electrically connected to the output terminal 101B of the rectifier circuit 10 via the third rectifier element D3. Note that an anode of the third rectifier element D3 is electrically connected to the output terminal 101B of the rectifier circuit 10, and a cathode of the third rectifier element D3 is electrically connected to a connection point of the capacitor C0 and one input end of the charging current control circuit 12.

A voltage that is less than or equal to the voltage of a difference (≈141−60=81 V) between a maximum value of the pulsating voltage and the reference voltage Vf1 of the first light source portion 2A is applied to the capacitor C0. Therefore, an electrolytic capacitor or a ceramic capacitor with a breakdown voltage of 100 V or more is preferably used as the capacitor C0.

Here, if it is assumed that the average current If1 of the first light source portion 2A is 0.1 A, and the charging start voltage of the capacitor C0 is 60 V, the capacitor C0 is charged for a period during which the output voltage (pulsating voltage) of the rectifier circuit 10 is in a range of 120 to 141 V. In the case where the power supply frequency of the AC power supply 3 is 50 Hz, the length of the period during which the pulsating voltage is in a range of 120 to 141 V is approximately 3.5 milliseconds. In the case where, in the period, the change of the voltage across the capacitor C0 is equal to the change of the pulsating voltage, the capacitor C0 is not charged after the pulsating voltage passes the maximum value, and as a result circuit efficiency decreases. Therefore, the capacitor C0 is desirably set to a capacitance value that minimizes a variation width of the charged voltage. For example, the voltage across the capacitor C0 is assumed to change in a range of 60V to 70V, under conditions where the average current If1 is 0.1 A and the charging period is 3 milliseconds. At this time, the capacitance value of the capacitor C0 is preferably set to (0.1 A×0.03 seconds)/(70 V−60 V)=30 μF or more. Note that as the capacitance value is larger, the variation width of the voltage across the capacitor C0 more decreases, the charging period becomes longer, and the size (external dimensions) of the capacitor C0 more increases. Therefore, the capacitor C0 is preferably set to an optimum capacitance value in relation to the size.

Incidentally, the first current control circuit 11, the second current control circuit 13, and the charging current control circuit 12 operate while influencing each other. That is, not only the output current of the first current control circuit 11 but also the output currents of the second current control circuit 13 and the charging current control circuit 12 flow in the resistor R1 of the first current control circuit 11. That is, as a result of the output current of the second current control circuit 13 or the charging current control circuit 12 increasing and the voltage across the resistor R1 increasing, the output current of the first current control circuit 11 decreases. Then, when the voltage drop in the resistor R1 (voltage across the resistor R1) due to the output currents of the second current control circuit 13 and the charging current control circuit 12 reaches the reference voltage of the shunt regulator U1, the first current control circuit 11 stops operation.

Similarly, not only the output current of the second current control circuit 13 but also the output current of the charging current control circuit 12 flows in the resistor R3 of the second current control circuit 13. That is, as a result of the output current of the charging current control circuit 12 increasing and the voltage across the resistor R3 increasing, the output current of the second current control circuit 13 decreases. Then, when the voltage drop in the resistor R3 (voltage across the resistor R3) due to the output current of the charging current control circuit 12 reaches the reference voltage of the shunt regulator U2, the second current control circuit 13 stops operation.

Next, operations of the illumination device including the light source and the lighting device 1 of the present embodiment will be described, with reference to the circuit block diagrams of FIGS. 2A to 2D and the time chart of FIG. 4.

There are four operation modes (first mode to fourth mode) in the lighting device 1 of the present embodiment. The first mode is an operation mode when the output voltage (pulsating voltage) of the rectifier circuit 10 is greater than or equal to the reference voltage Vf1 of the first light source portion 2A and less than or equal to a voltage that is the sum of the reference voltage Vf1 of the first light source portion 2A and the reference voltage Vf2 of the second light source portion 2B. In the first mode, a constant current If1 flows in the first light source portion 2A in a path that passes from the rectifier circuit 10 through the first light source portion 2A, the first current control circuit 11, and the rectifier circuit 10 in this order, as shown by the solid line α in FIG. 2A, and the first light source portion 2A is lighted.

The second mode is an operation mode when the output voltage of the rectifier circuit 10 is greater than or equal to the voltage that is the sum of the two reference voltages Vf1 and Vf2 and less than or equal to a voltage that is the sum of the reference voltage Vf1 and the voltage $V_{C0}$ across the capacitor C0. In the second mode, a constant current If2 flows in the first light source portion 2A and the second light source portion 2B in a path that passes from the rectifier circuit 10 through the first light source portion 2A, the second light source portion 2B, the second current control circuit 13, and the rectifier circuit 10 in this order, as shown by the solid line β in FIG. 2B, and the first light source portion 2A and the second light source portion 2B are lighted.

The third mode is an operation mode when the output voltage of the rectifier circuit 10 is larger than the voltage that is the sum of the reference voltage Vf1 and the voltage $V_{C0}$ across the capacitor C0. In the third mode, a charging current flows in a path that passes from the output terminal 101A of the rectifier circuit 10 through the first light source portion 2A, the first rectifier element D1, the capacitor C0, the charging current control circuit 12, the fourth rectifier element D4, and the output terminal 101B of the rectifier circuit 10 in this order, as shown by the solid line γ in FIG. 2C. The first light source portion 2A is lighted with this charging current.

The fourth mode is an operation mode when the output voltage of the rectifier circuit 10 is less than or equal to the voltage $V_{C0}$ across the capacitor C0. In the fourth mode, a discharge current flows in a path that passes from the capacitor C0 through the second rectifier element D2, the first light source portion 2A, the first current control circuit 11, the third rectifier element D3, and the capacitor C0 in this order, as indicated by the solid line δ in FIG. 2D, and the first light source portion 2A is lighted.

That is to say, the lighting device 1 of the present embodiment is configured to operate in operation modes in order of the fourth mode, the first mode, the second mode, the third mode, the second mode, the first mode, and the fourth mode, in one cycle in which the output voltage of the rectifier circuit 10 changes from 0 V and then returns to 0 V via the maximum value (141 V).

Figure 4:
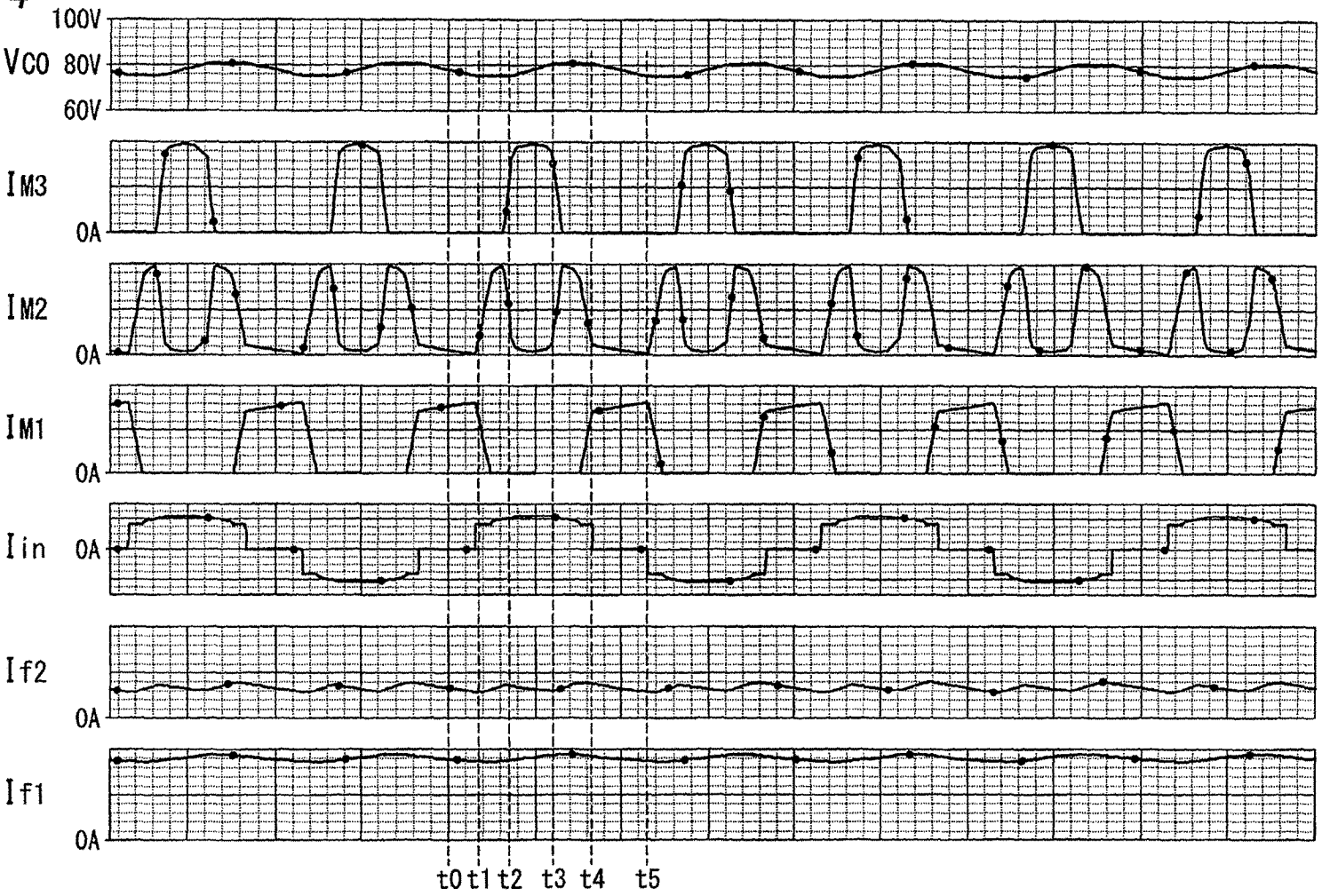
FIG. 4 is a time chart for describing operations of the lighting device and the illumination device according to Embodiment 1.

FIG. 4 shows a current in each portion when the lighting device 1 of the present embodiment is performing steady operation.

In FIG. 4, $I_{M3}$ is a drain current of the transistor M3 in the charging current control circuit 12, $I_{M2}$ is a drain current of the transistor M2 in the second current control circuit 13, and $I_{M1}$ is a drain current of the transistor M1 in the first current control circuit 11. Also, $I_{in}$ in FIG. 4 is an input current that flows into the input terminals 100A and 100B of the rectifier circuit 10 from the AC power supply 3.

Time t=t0 is a zero crossing point of the pulsating voltage (power supply voltage of the AC power supply 3), and the output voltage of the rectifier circuit 10 (pulsating voltage) is 0 V. At this time, since the voltage $V_{C0}$ across the capacitor C0 is larger than the output voltage of the rectifier circuit 10, the input current $I_{in}$ does not flow, the lighting device 1 operates in the fourth mode, and the first light source portion 2A is lighted with the discharge current of the capacitor C0.

When the output voltage of the rectifier circuit 10 increases and exceeds the voltage $V_{C0}$ across the capacitor C0 (time t=t1), the lighting device 1 shifts to the first mode, and the first light source portion 2A continues to be lighted. Then, when the output voltage of the rectifier circuit 10 reaches the voltage that is the sum of the two reference voltages Vf1 and Vf2, the lighting device 1 shifts to the second mode, the first current control circuit 11 stops operation, the second current control circuit 13 operates, and as a result the first light source portion 2A and the second light source portion 2B are lighted.

When the output voltage of the rectifier circuit 10 reaches the voltage that is the sum of the reference voltage Vf1 and the voltage $V_{C0}$ across the capacitor C0 (time t=t2), the lighting device 1 shifts to the third mode, the first current control circuit 11 and the second current control circuit 13 stop operation, the charging current control circuit 12 operates, and as a result the capacitor C0 is charged. At this time, the first light source portion 2A is lighted with the charging current to the capacitor C0.

When the output voltage of the rectifier circuit 10 passes the maximum value and becomes less than the voltage that is the sum of the reference voltage Vf1 and the voltage $V_{C0}$ across the capacitor C0 (time t=t3), the lighting device 1 shifts to the second mode, the second current control circuit 13 operates, and as a result the first light source portion 2A and the second light source portion 2B are lighted. Furthermore, when the output voltage of the rectifier circuit 10 becomes less than the voltage that is the sum of the two reference voltages Vf1 and Vf2, the lighting device 1 shifts to the first mode, the second current control circuit 13 stops operation, the first current control circuit 11 operates, and as a result the first light source portion 2A is lighted. Note that the voltage $V_{C0}$ across the capacitor C0 does not change.

When the output voltage of the rectifier circuit 10 becomes less than the voltage $V_{C0}$ across the capacitor C0 (time t=t4), the lighting device 1 shifts to the fourth mode, and the first light source portion 2A is lighted with the discharge current from the capacitor C0. The voltage $V_{C0}$ across the capacitor C0 decreases due to discharging. Here, when the lighting device 1 shifts from the first mode to the fourth mode, a current that changes steeply may flow in the second rectifier element D2 and the third rectifier element D3. It is possible that the input current $I_{in}$ changes rapidly due to the steep current, and noise caused by the rapid change of the input current $I_{in}$ leaks into the AC power supply 3. Therefore, in the lighting device 1 of the present embodiment, the rapid current change is suppressed by a resistor R99 inserted between the second rectifier element D2 and the output terminal 101A of the rectifier circuit 10. Note that inductance may be used in place of the resistor R99. If the inductance is used, loss can be reduced compared with a case where the resistor R99 is used.

Time t=t5 is a zero crossing point of the pulsating voltage, similarly to the time t=t0, the lighting device 1 operates in the fourth mode, and the first light source portion 2A is lighted with the discharge current of the capacitor C0.

Here, there is a problem in the conventional example described in Document 1 in that a transient current in a transient period flows in each of the charging circuit and the discharging circuit, loss occurs in each of the charging circuit and the discharging circuit, and as a result efficiency decreases.

On the other hand, the lighting device 1 of the present embodiment is configured such that only one of the first current control circuit 11 (or the second current control circuit 13) and the charging current control circuit 12 is operated in any of the operation modes from the first mode to the fourth mode, as described above. That is, in the lighting device 1 of the present embodiment, the first current control circuit 11 (or the second current control circuit 13) and the charging current control circuit 12 will not be included in the same closed circuit at any time, and thus efficiency can be improved compared with the conventional example described in Document 1.

As described above, the lighting device 1 of the present embodiment includes the rectifier circuit 10, the current control circuit (first current control circuit 11), the storage element (capacitor C0), the charging current control circuit 12, the first rectifier element D1, the second rectifier element D2, and the third rectifier element D3. The rectifier circuit 10 is configured to rectify a sine wave AC voltage inputted between the pair of input terminals 100A and 100B and output a pulsating voltage from the pair of output terminals 101A and 101B. The current control circuit (first current control circuit 11) is electrically connected in series to a light source (first light source portion 2A) between the pair of output terminals 101A and 101B. Also, the current control circuit (first current control circuit 11) is configured to control a current that flows in the light source (first light source portion 2A) such that the current does not exceed a predetermined value (0.124 A, for example). The storage element (capacitor C0) is electrically connected in series to the charging current control circuit 12 between the two ends of the current control circuit (first current control circuit 11). The charging current control circuit 12 is configured to control a charging current that flows to the storage element (capacitor C0). The first rectifier element D1 is for causing the charging current to flow to the storage element (capacitor C0) via the light source (first light source portion 2A) and not via the current control circuit (first current control circuit 11). The second rectifier element D2 is for causing a discharge current that is discharged from the storage element (capacitor C0) to flow to the light source (first light source portion 2A). The third rectifier element D3 is for causing the discharge current to flow bypassing the charging current control circuit 12.

Since the lighting device 1 of the present embodiment is configured to not have a period during which current is caused to flow in the current control circuit (first current control circuit 11) and the charging current control circuit 12 at the same time, efficiency can be improved compared with the conventional example described in Document 1.

The lighting device 1 of the present embodiment preferably further includes the second current control circuit 13, in addition to the first current control circuit 11 as the current control circuit 11. It is preferable that the second current control circuit 13 is electrically connected in series to the second light source (second light source portion 2B) between the two ends of the current control circuit (first current control circuit 11), which is different from the first light source (first light source portion 2A) as the light source (first light source portion 2A). Furthermore, the second current control circuit 13 is preferably configured to control a current that flows in the second light source (second light source portion 2B) such that the current does not exceed a second predetermined value (the same value as the predetermined value (first predetermined value) of the first current control circuit 11, for example), which is equal to or different from a first predetermined value as the predetermined value.

If the lighting device 1 of the present embodiment is configured as described above, light conversion efficiency can be improved by lighting two or more light sources (first light source portion 2A and second light source portion 2B). Furthermore, if the series circuit of the light source (second light source portion 2B) and the second current control circuit 13 is electrically connected in parallel to the current control circuit (first current control circuit 11), loss in the current control circuit (first current control circuit 11) can be reduced. Note that a series circuit of a light source (third light source portion) and a current control circuit (third current control circuit) may be electrically connected in parallel to the second current control circuit 13.

In the lighting device 1 of the present embodiment, the current control circuit (first current control circuit 11) is preferably configured to not control a current that flows to the light source (first light source portion 2A) in the period (third mode) in which the charging current flows to the storage element (capacitor C0). That is, the lighting device 1 of the present embodiment is preferably configured to stop operation of the first current control circuit 11 in the third mode.

Furthermore, in the lighting device 1 of the present embodiment, the second current control circuit 13 is preferably configured to not control a current that flows in the second light source (second light source portion 2B) in the period (third mode) in which the charging current flows to the storage element (capacitor C0). That is, the lighting device 1 of the present embodiment is preferably configured to stop operation of the second current control circuit 13 in the third mode.

If the lighting device 1 of the present embodiment is configured as described above, a loss can be reliably reduced by stopping operation of the first current control circuit 11 or the second current control circuit 13.

In the lighting device 1 of the present embodiment, the charging current control circuit 12 is preferably configured to control the charging current to be larger than the predetermined value (and the second predetermined value of the second current control circuit 13) of the current control circuit (first current control circuit 11).

In the lighting device 1 of the present embodiment, the current control circuit (first current control circuit 11) is preferably configured to not control the discharge current to be the predetermined value. That is, the lighting device 1 of the present embodiment is configured to stop operation of the current control circuit (first current control circuit 11) in the third mode in which the storage element (capacitor C0) is charged.

Furthermore, in the lighting device 1 of the present embodiment, a current-limiting element (resistor R99) is preferably provided in a path in which the discharge current flows. If the lighting device 1 of the present embodiment is configured as described above, a rapid change in the input current $I_{in}$ can be suppressed by the current-limiting element, and a harmonic component of the input current can be reduced.

The illumination device of the present embodiment includes one or more light sources (first light source portion 2A and second light source portion 2B), and the lighting device 1. The one or more light sources (first light source portion 2A and second light source portion 2B) include one or more solid-state light-emitting elements (light-emitting diodes 20A and 20B).

In the illumination device of the present embodiment, the light source (first light source portion 2A), which is electrically connected in series to the current control circuit (first current control circuit 11), of the one or more light sources (first light source portion 2A and second light source portion 2B) is preferably configured to emit light in a case where a voltage that is not lower than a reference voltage is applied. The reference voltage is preferably a voltage (60 V, for example) that is less than or equal to half of the peak value (141 V) of the pulsating voltage.

Figure 5:
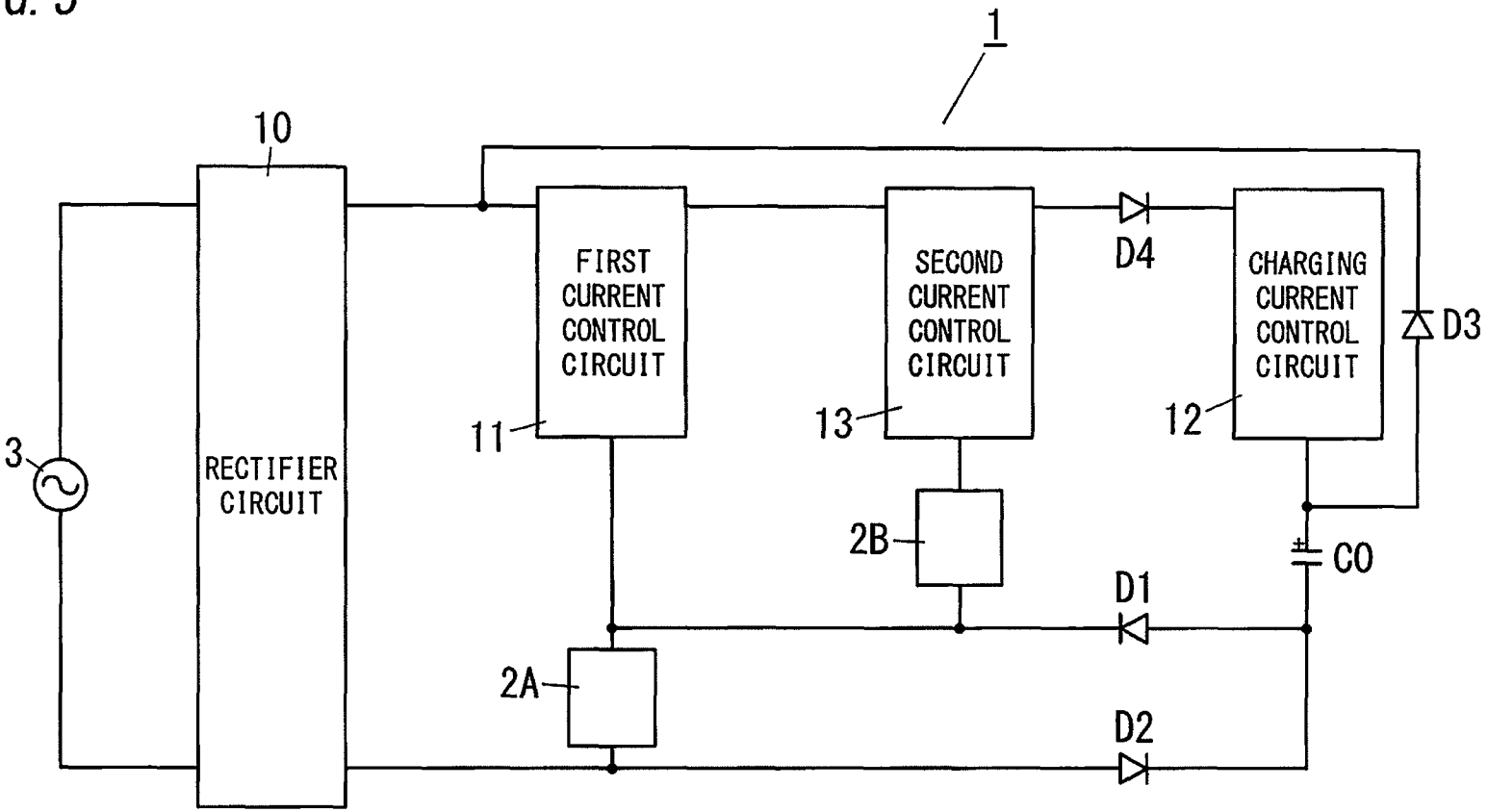
FIG. 5 is a block diagram illustrating another configuration of the lighting device and the illumination device according to Embodiment 1.

As a variation of the lighting device 1 of the present embodiment, the first current control circuit 11, the second current control circuit 13, and the charging current control circuit 12 may be configured to be electrically connected to the output terminal 101A on a high potential side of the rectifier circuit 10, as shown in FIG. 5. Note that, since the basic operations are in common even if the lighting device 1 of the present embodiment is configured as shown in FIG. 5, detailed description will be omitted.

(Embodiment 2)

A lighting device 1 and an illumination device according to Embodiment 2 will be described in detail, with reference to FIGS. 6 and 7. Note that the lighting device 1 of the present embodiment differs from the lighting device 1 of Embodiment 1 in that two storage elements (capacitors C01 and C02) are included. Accordingly, constituent elements in common with the lighting device 1 of Embodiment 1 are provided with the same reference numerals, and description and illustration thereof will be omitted.

Figure 6:
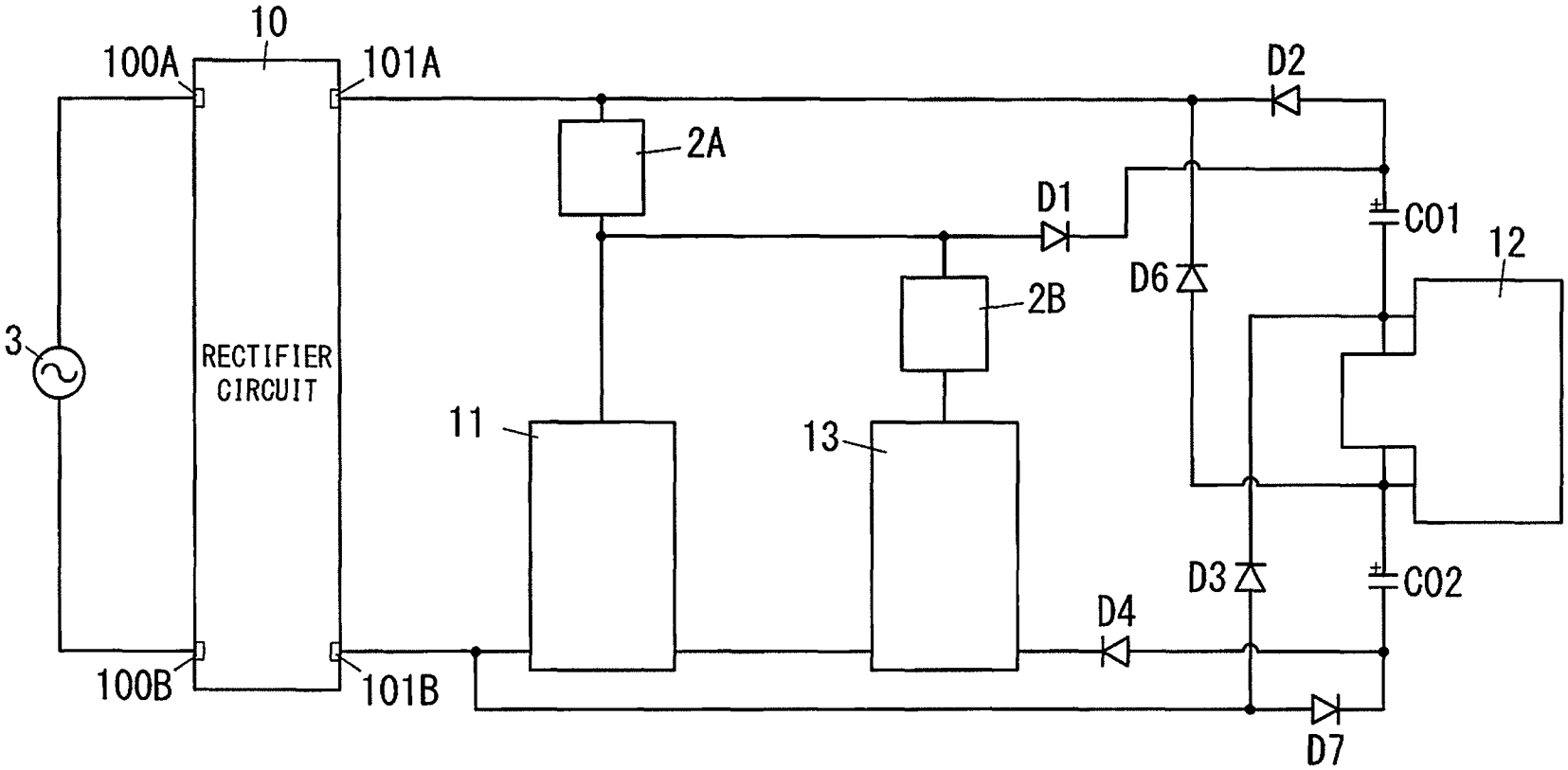
FIG. 6 is a block diagram illustrating a lighting device and an illumination device according to Embodiment 2.

The lighting device 1 of the present embodiment includes a series circuit of a first storage element (capacitor C01), a charging current control circuit 12, and a second storage element (capacitor C02), as shown in FIG. 6. The series circuit is electrically connected between output terminals 101A and 101B of a rectifier circuit 10 via two rectifier elements (second rectifier element D2 and seventh rectifier element D7).

One end of the capacitor C02 is electrically connected to a cathode of the seventh rectifier element D7 and an anode of a fourth rectifier element D4. An anode of the seventh rectifier element D7 is electrically connected to the output terminal 101B of the rectifier circuit 10 and an anode of a third rectifier element D3. Also, an anode of a sixth rectifier element D6 is electrically connected to a connection point of the charging current control circuit 12 and the capacitor C02, and a cathode of the sixth rectifier element D6 is electrically connected to the output terminal 101A of the rectifier circuit 10.

Next, operations of the lighting device 1 of the present embodiment will be described. Note that, since operations in a first mode and a second mode are in common with Embodiment 1, only operations in a third mode and a fourth mode that are different from Embodiment 1 will be described with reference to FIGS. 7A and 7B.

Figure 7A:
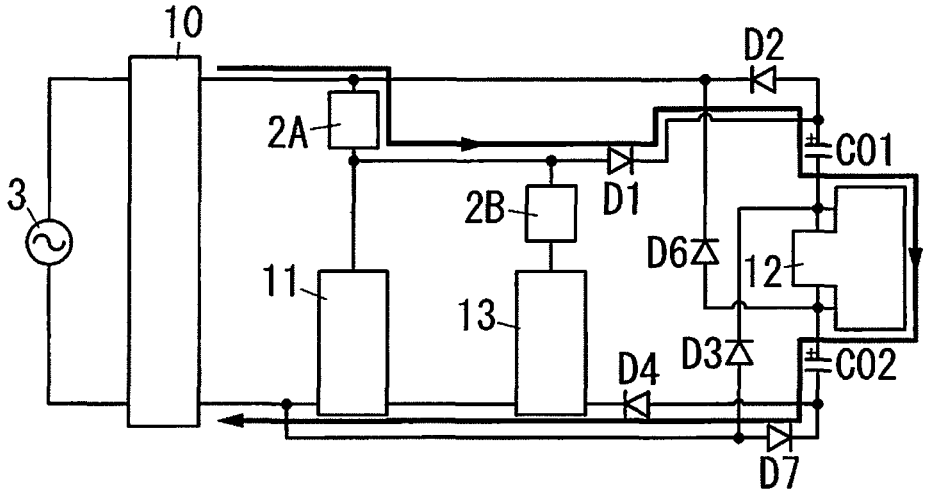
FIGS. 7A and 7B are block diagram for describing operations of the lighting device and the illumination device according to Embodiment 2.

In the third mode, the lighting device 1 causes a charging current to flow in a path that passes from the rectifier circuit 10 through a first light source portion 2A, a first rectifier element D1, the capacitor C01, the charging current control circuit 12, the capacitor C02, the fourth rectifier element D4, and the rectifier circuit 10 in this order, as shown in FIG. 7A.

Figure 7B:
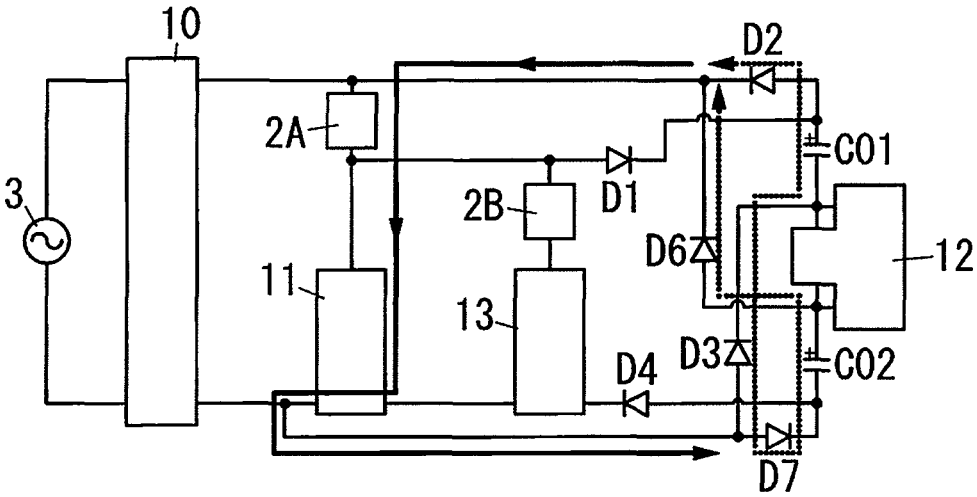

In the fourth mode, a discharge current of the capacitor C01 flows in a path that passes from the capacitor C01 through the second rectifier element D2, the first light source portion 2A, a first current control circuit 11, the seventh rectifier element D7, the third rectifier element D3, and the capacitor C01 in this order, as shown in FIG. 7B. Also, a discharge current of the capacitor C02 flows in a path that passes from the capacitor C02 through the sixth rectifier element D6, the first light source portion 2A, the first current control circuit 11, the seventh rectifier element D7, and the capacitor C02 in this order.

That is to say, the lighting device 1 of the present embodiment is configured to cause the charging current to flow to the series circuit of the two capacitors C01 and C02 and charge the capacitors in the third mode, and cause the discharge current to flow from a parallel circuit of the two capacitors C01 and C02 in the fourth mode.

Here, a sine wave AC voltage having an effective value of 200 V (volts) is assumed to be supplied from an AC power supply 3, and a reference voltage Vf1 of the first light source portion 2A is assumed to be set to a voltage (less than or equal to 94 V) that is less than or equal to a third of a maximum value (283 V) of a power supply voltage. In the present embodiment, the reference voltage Vf1 of the first light source portion 2A is set to 84 V. A charged voltage of the series circuit of the two capacitors C01 and C02 is 200 V at the maximum. Since the two capacitors C01 and C02 are electrically connected in parallel to a load (first light source portion 2A and first current control circuit 11) at the time of discharging, each of the two capacitors C01 and C02 applies a voltage of 100 V to the load. That is, an electrolytic capacitor or the like having a breakdown voltage of approximately 100V can be used as each of the capacitors C01 and C02.

As described above, in the lighting device 1 of the present embodiment, the capacitors C01 and C02 do not need to have a higher breakdown voltage, even if the power supply voltage of the AC power supply 3 is higher than that in Embodiment 1, and as a result an increase in size is suppressed.

(Embodiment 3)

Figure 8A:
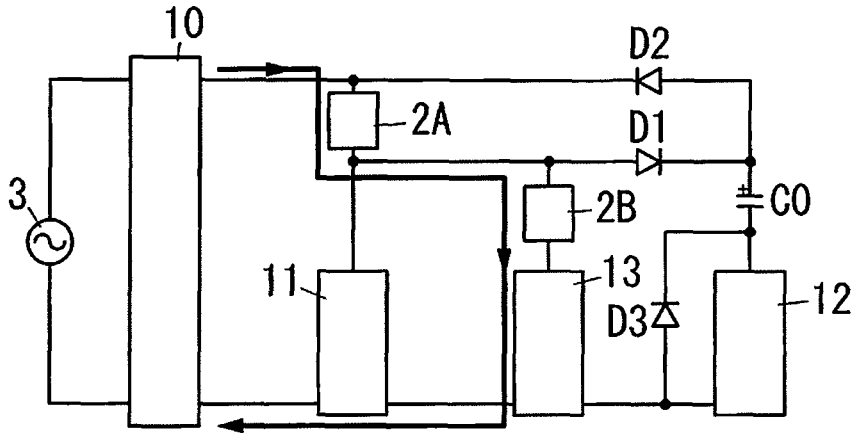
FIGS. 8A to 8C are block diagrams for describing operations of a lighting device and an illumination device according to Embodiment 3.

A lighting device 1 and an illumination device according to Embodiment 3 will be described in detail, with reference to FIGS. 8A to 8C. Note that the lighting device 1 of the present embodiment differs from the lighting device 1 of Embodiment 1 in that the fourth rectifier element D4 is omitted, and a third rectifier element D3 is electrically connected in parallel to a charging current control circuit 12. Accordingly, constituent elements in common with the lighting device 1 of Embodiment 1 are provided with the same reference numerals, and description and illustration thereof will be omitted.

Next, the operations of the illumination device including the light source and the lighting device 1 of the present embodiment will be described with reference to the circuit block diagrams of FIGS. 8A to 8C and the time chart of FIG. 9.

Description of operations in a first mode will be omitted since the operations are in common with Embodiment 1. In a second mode, a constant current If2 flows in a path that passes from a rectifier circuit 10 through a first light source portion 2A, a second light source portion 2B, a second current control circuit 13, and the rectifier circuit 10 in this order, as indicated by the solid line in FIG. 8A, and both the first light source portion 2A and the second light source portion 2B are lighted.

Figure 8B:
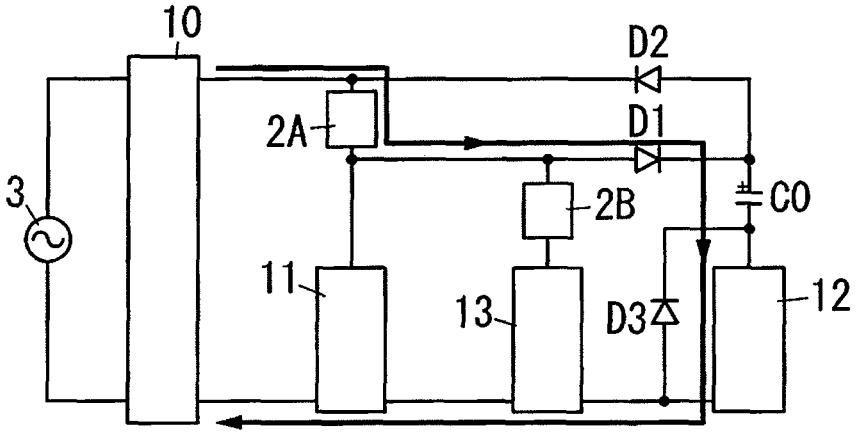

In a third mode, a charging current flows to a capacitor C0 via the first light source portion 2A in a path that passes from the rectifier circuit 10 through the first light source portion 2A, the first rectifier element D1, the capacitor C0, the charging current control circuit 12, and the rectifier circuit 10 in this order, as indicated by the solid line in FIG. 8B, and the first light source portion 2A is lighted.

Figure 8C:
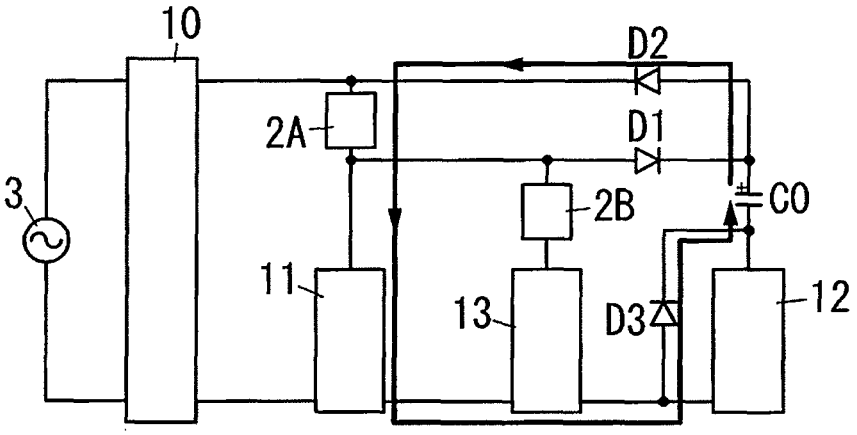

In a fourth mode, a discharge current flows in a path that passes from the capacitor C0 through a second rectifier element D2, the first light source portion 2A, and a first current control circuit 11, the third rectifier element D3, and the capacitor C0 in this order, as indicated by the solid line in FIG. 8C, and the first light source portion 2A is lighted.

Figure 9:
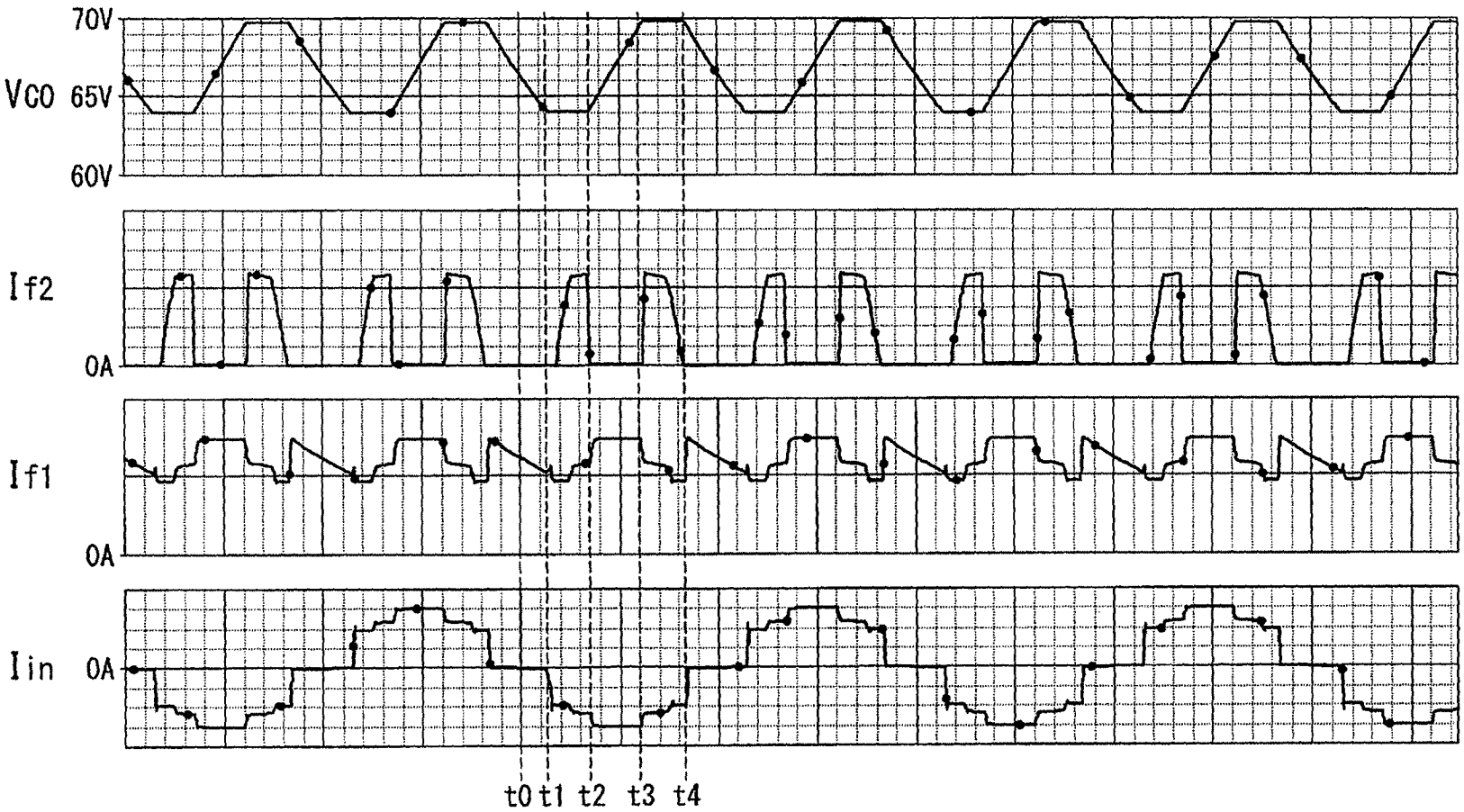
FIG. 9 is a time chart for describing operations of the lighting device and the illumination device according to Embodiment 3.

Time t=t0 is a zero crossing point of a pulsating voltage (power supply voltage of the AC power supply 3), as shown in FIG. 9, and an output voltage of the rectifier circuit 10 (pulsating voltage) is 0 V. At this time, since a voltage $V_{C0}$ across the capacitor C0 is larger than the output voltage of the rectifier circuit 10, an input current $I_{in}$ does not flow, the lighting device 1 operates in the fourth mode, and the first light source portion 2A is lighted with the discharge current of the capacitor C0.

When the output voltage of the rectifier circuit 10 increases and exceeds the voltage across the capacitor C0 (time t=t1), the lighting device 1 shifts to the first mode, and the first light source portion 2A continues to be lighted. Furthermore, when the output voltage of the rectifier circuit 10 reaches the voltage that is the sum of the two reference voltages Vf1 and Vf2, the lighting device 1 shifts to the second mode, the first current control circuit 11 stops operation, the second current control circuit 13 operates, and as a result the first light source portion 2A and the second light source portion 2B are lighted.

When the output voltage of the rectifier circuit 10 reaches the voltage that is the sum of the reference voltage Vf1 and the voltage $V_{C0}$ across the capacitor C0 (time t=t2), the lighting device 1 shifts to the third mode, the first current control circuit 11 and the second current control circuit 13 stop operation, the charging current control circuit 12 operates, and the capacitor C0 is charged. At this time, the first light source portion 2A is lighted with the charging current of the capacitor C0.

When the output voltage of the rectifier circuit 10 passes the maximum value and becomes less than the voltage that is the sum of the reference voltage Vf1 and the voltage $V_{C0}$ across the capacitor C0 (time t=t3), the lighting device 1 shifts to the second mode, the second current control circuit 13 operates, and as a result the first light source portion 2A and the second light source portion 2B are lighted. Furthermore, when the output voltage of the rectifier circuit 10 becomes less than the voltage that is the sum of the two reference voltages Vf1 and Vf2, the lighting device 1 shifts to the first mode, the second current control circuit 13 stops operation, the first current control circuit 11 operates, and as a result the first light source portion 2A is lighted. Note that the voltage $V_{C0}$ across the capacitor C0 does not change.

When the output voltage of the rectifier circuit 10 becomes less than the voltage $V_{C0}$ across the capacitor C0 (time t=t4), the lighting device 1 shifts to the fourth mode, and the first light source portion 2A is lighted with the discharge current of the capacitor C0. Here, since the fourth rectifier element D4 is omitted in the first current control circuit 11 of the lighting device 1 of the present embodiment, the discharge current that flows via a transistor M1 is outputted without passing through a resistor R1. That is, since a voltage drop does not occur in the resistor R1, the transistor M1 in the first current control circuit 11 completely becomes an on state. Since the transistor M1 completely becomes the on state, as described above, loss in the first current control circuit 11 can be reduced compared with Embodiment 1. Note that, since the voltage $V_{C0}$ across the capacitor C0 remains within the voltage range for the period of time t=t2 to t3, excess current does not flow in the first light source portion 2A even if the transistor M1 completely becomes the on state.

As described above, in the lighting device 1 of the present embodiment, loss can be reduced at the time of discharging the capacitor C0 and luminous efficiency can be improved. A parasitic diode included in the transistor M3 in the charging current control circuit 12 may be used as a substitute for the third rectifier element D3. If the third rectifier element D3 is substituted by the parasitic diode of the transistor M3, the number of components can be reduced.

(Embodiment 4)

Figure 10:
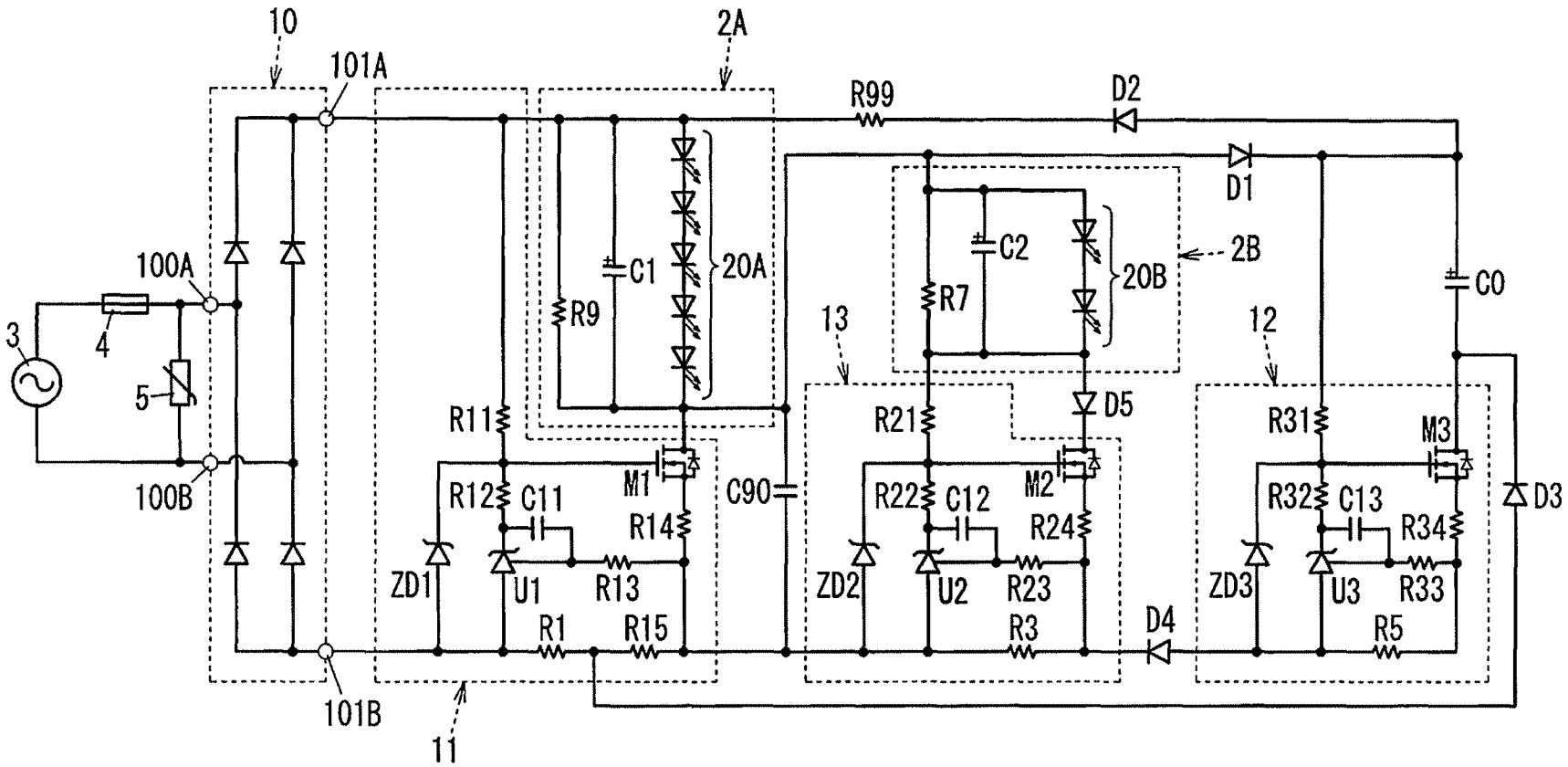
FIG. 10 is a circuit configuration diagram illustrating a lighting device and an illumination device according to Embodiment 4.

A lighting device 1 and an illumination device according to Embodiment 4 will be described in detail, with reference to FIG. 10. Note that the lighting device 1 of the present embodiment differs from the lighting device 1 of Embodiment 1 in that a first current control circuit 11 has a partially different configuration. Accordingly, constituent elements in common with the lighting device 1 of Embodiment 1 are provided with the same reference numerals, and description and illustration thereof will be omitted.

In the first current control circuit 11 in the present embodiment, a resistor R15 is electrically connected in series to a resistor R1, and an anode of a third rectifier element D3 is electrically connected to a connection point of the resistor R1 and the resistor R15.

In the lighting device 1 of the present embodiment, in a first mode, a current flows in a path that passes from a rectifier circuit 10 through a first light source portion 2A, a transistor M1, a resistor R14, the resistor R15, the resistor R1, and the rectifier circuit 10 in this order. The first current control circuit 11 controls a drain current of the transistor M1 (to be constant current) by increasing or decreasing a cathode current such that the voltage drop in the series circuit of the resistors R1 and R15 equals to a reference voltage of a shunt regulator U1.

On the other hand, in the lighting device 1 of the present embodiment, in a fourth mode, a discharge current flows in a path that passes from a capacitor C0 through a second rectifier element D2, a resistor R99, the first light source portion 2A, the transistor M1, the resistor R14, the resistor R15, the third rectifier element D3, and the capacitor C0 in this order. That is, the first current control circuit 11 controls the drain current of the transistor M1 by increasing or decreasing a cathode current such that the voltage drop in the resistor R15 equals to the reference voltage of the shunt regulator U1.

Accordingly, the first current control circuit 11 operates so as to control the discharge current with an upper limit value higher than the upper limit value in the first mode.

In the lighting device 1 of the present embodiment, fluctuation in the discharge current can be suppressed compared with the lighting device 1 of Embodiment 3, by controlling (to a constant current) the discharge current of the capacitor C0 with the first current control circuit 11.

(Embodiment 5)

A lighting device 1 and an illumination device according to Embodiment 5 will be described in detail, with reference to FIGS. 11 and 12. Note that the basic configuration of the lighting device 1 of the present embodiment is in common with the lighting device 1 of Embodiment 1, and thus constituent elements in common with the lighting device 1 of Embodiment 1 are provided with the same reference numerals, and description and illustration thereof will be omitted.

Figure 11:
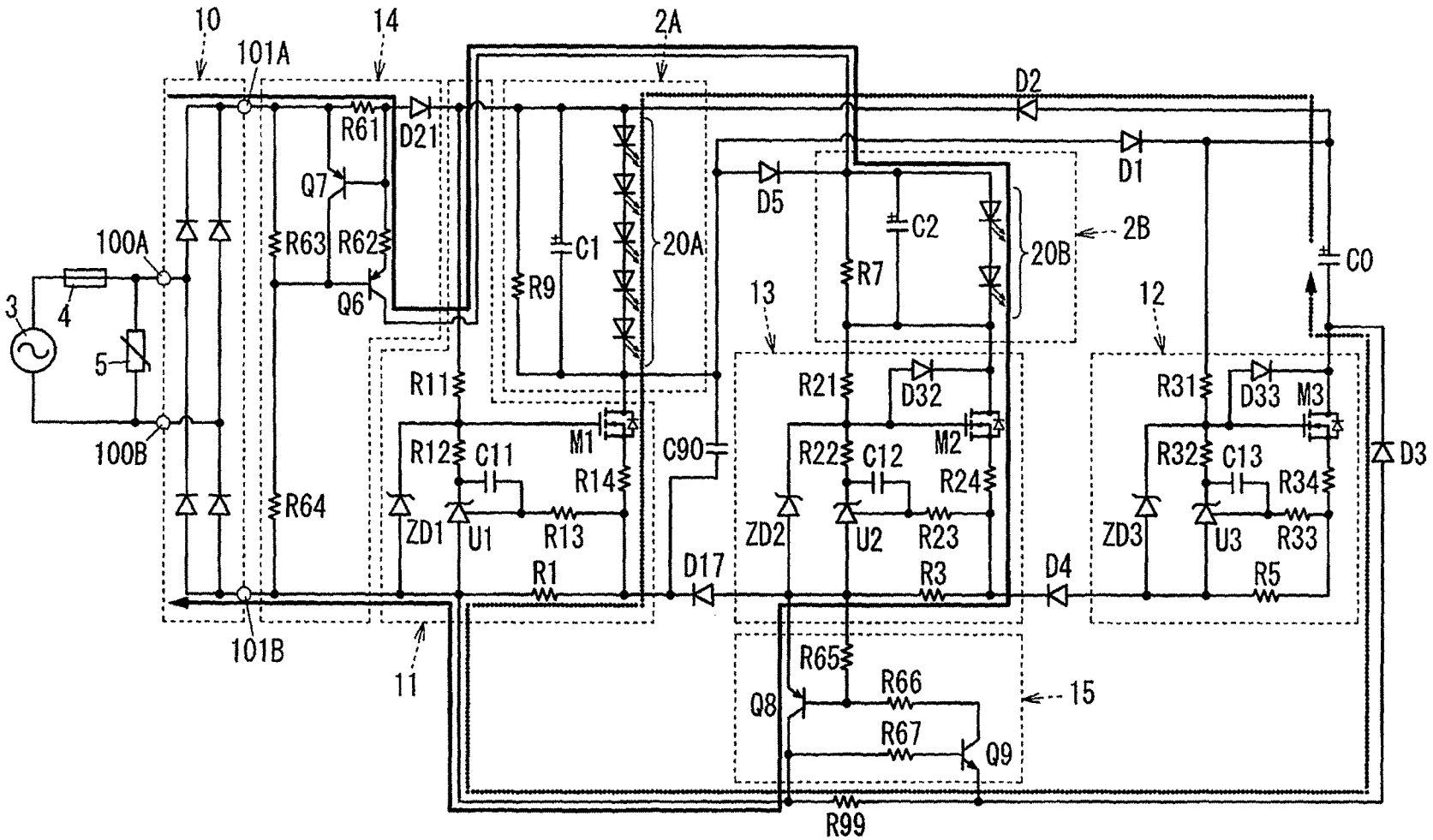
FIG. 11 is a circuit configuration diagram illustrating a lighting device and an illumination device according to Embodiment 5.

The lighting device 1 of the present embodiment preferably includes a first bypass circuit 14 and a second bypass circuit 15, as shown in FIG. 11. It is preferable that, in the lighting device 1 of the present embodiment, a bypass diode D33 is connected between a gate and a drain of a transistor M3 in a charging current control circuit 12, and a bypass diode D32 is connected between a gate and a drain of a transistor M2 in a second current control circuit 13. Furthermore, it is preferable that, in the lighting device 1 of the present embodiment, diodes D5 and D17 are inserted between a first current control circuit 11 and a series circuit of a second light source portion 2B and the second current control circuit 13.

The bypass diodes D32 and D33 are electrically connected to respective transistors M2 and M3, each diode being connected between the gate and drain of the corresponding transistor with its anode on the gate side. These bypass diodes D32 and D33 contribute to suppress fluctuation in an input current $I_{in}$ when an operation mode shifts. For example, the bypass diode D33 can suppress a rapid increase of a drain current of the transistor M3 when shifting from a second mode to a third mode.

Since the bypass diode D33 is not included in Embodiment 1, the voltage between the gate and source of the transistor M3 in the second mode is kept at a zener voltage of a zener diode ZD3, and the transistor M3 completely becomes an on state. Therefore, when an output voltage of the rectifier circuit 10 increases, and a charging current begins to flow to the capacitor C0, a drain current of the transistor M3 that is completely in the on state rapidly increases.

On the other hand, if the bypass diode D33 is connected between the gate and drain of the transistor M3, the voltage between the gate and source of the transistor M3 is clamped to the voltage between the drain and source thereof. That is, the voltage between the gate and source of the transistor M3 is kept approximately at a gate threshold voltage. At this time, even if the output voltage of the rectifier circuit 10 increases, and a charging current begins to flow to the capacitor C0, since the transistor M3 is not completely in the on state, the drain current does not increase rapidly, and current control with a shunt regulator U3 can be performed smoothly.

The first bypass circuit 14 and the second bypass circuit 15 are configured, as shown in FIG. 11, such that output terminals 101A and 101B of the rectifier circuit 10 are electrically connected to the series circuit of the second light source portion 2B and the second current control circuit 13 without a first light source portion 2A and the first current control circuit 11 being interposed.

The first bypass circuit 14 includes a first switch element Q6 and a second switch element Q7 that are each constituted by a pnp-type bipolar transistor, resistors R61, R62, R63, and R64, and a diode D21. A series circuit of the resistors R63 and R64 is electrically connected between the output terminals 101A and 101B of the rectifier circuit 10. An emitter of the second switch element Q7 is electrically connected to the output terminal 101A of the rectifier circuit 10, and a collector of the second switch element Q7 is electrically connected to a connection point of the resistors R63 and R64. The resistor R61 is electrically connected between the emitter and base of the second switch element Q7, and is connected to an anode of the diode D21. A cathode of the diode D21 is electrically connected to a positive electrode of the first light source portion 2A. The base of the first switch element Q6 is electrically connected to the collector of the second switch element Q7, and the emitter of the first switch element Q6 is electrically connected to the base of the second switch element Q7 via the resistor R62. The collector of the first switch element Q6 is electrically connected to a positive electrode of the second light source portion 2B.

The second switch element Q7 is configured to be in an off state when a voltage drop in the resistor R61 due to the input current $I_{in}$ is less than a threshold voltage, and in an on state when the voltage drop in the resistor R61 is greater than or equal to the threshold voltage. The first switch element Q6 is configured to be in an on state when the output voltage of the rectifier circuit 10 is greater than or equal to a predetermined value and the second switch element Q7 is in an off state, and in an off state when the output voltage of the rectifier circuit 10 is less than the predetermined value or the second switch element Q7 is in an on state.

That is to say, the first bypass circuit 14 is configured such that when the first switch element Q6 is in an on state, the second light source portion 2B and the second current control circuit 13 are electrically connected between the output terminals 101A and 101B of the rectifier circuit 10 without the first light source portion 2A and the first current control circuit 11 being interposed.

The second bypass circuit 15 includes a third switch element Q8 and a fourth switch element Q9 that are each constituted by an npn-type bipolar transistor, and resistors R65, R66, and R67. An emitter of the third switch element Q8 is electrically connected to an anode of a zener diode ZD2 in the second current control circuit 13. A collector of the third switch element Q8 is electrically connected to a base of the fourth switch element Q9 via the resistor R67. Furthermore, a base of the third switch element Q8 is electrically connected to an anode of a shunt regulator U2 in the second current control circuit 13 via the resistor R65 and is electrically connected to a collector of the fourth switch element Q9 via the resistor R66. An emitter of the fourth switch element Q9 is electrically connected to the anode of the third rectifier element D3 and the resistor R99. Note that the resistor R99 is inserted between the anode of the third rectifier element D3 and an anode of the shunt regulator U1 in the first current control circuit 11.

The fourth switch element Q9 is configured to be in an off state when a voltage drop in the resistor R99 due to a discharge current is less than a threshold voltage, and in an on state when the voltage drop in the resistor R99 is greater than or equal to the threshold voltage. The third switch element Q8 is configured to be in an off state when the fourth switch element Q9 is in an off state, and in an on state when the fourth switch element Q9 is in an on state.

That is to say, the lighting device 1, in a fourth mode, causes the second light source portion 2B to be lighted by causing current to flow in a path that passes from the rectifier circuit 10 through the first bypass circuit 14, the second light source portion 2B, the second current control circuit 13, the second bypass circuit 15, and the rectifier circuit 10 in this order. Note that, since a current bypassed through the second bypass circuit 15 does not flow in a resistor R1 in the first current control circuit 11, the first current control circuit 11 is not influenced by the current and can control a discharge current from the capacitor C0 to be a constant current.

Here, a diode D17 is inserted between the emitter of the third switch element Q8 and the resistor R1 in the first current control circuit 11, while the cathode thereof being on the resistor R1 side. That is, in the fourth mode, the discharge current flowing from the capacitor C0 to the first light source portion 2A and the first current control circuit 11 does not flow to the second current control circuit 13, due to being blocked by the diode D17, and flows via the resistor R99 and the third rectifier element D3.

Next, operations of the illumination device including the light source and the lighting device 1 of the present embodiment will be described with reference to the circuit configuration diagram of FIG. 11 and the time chart of FIG. 12.

Figure 12:
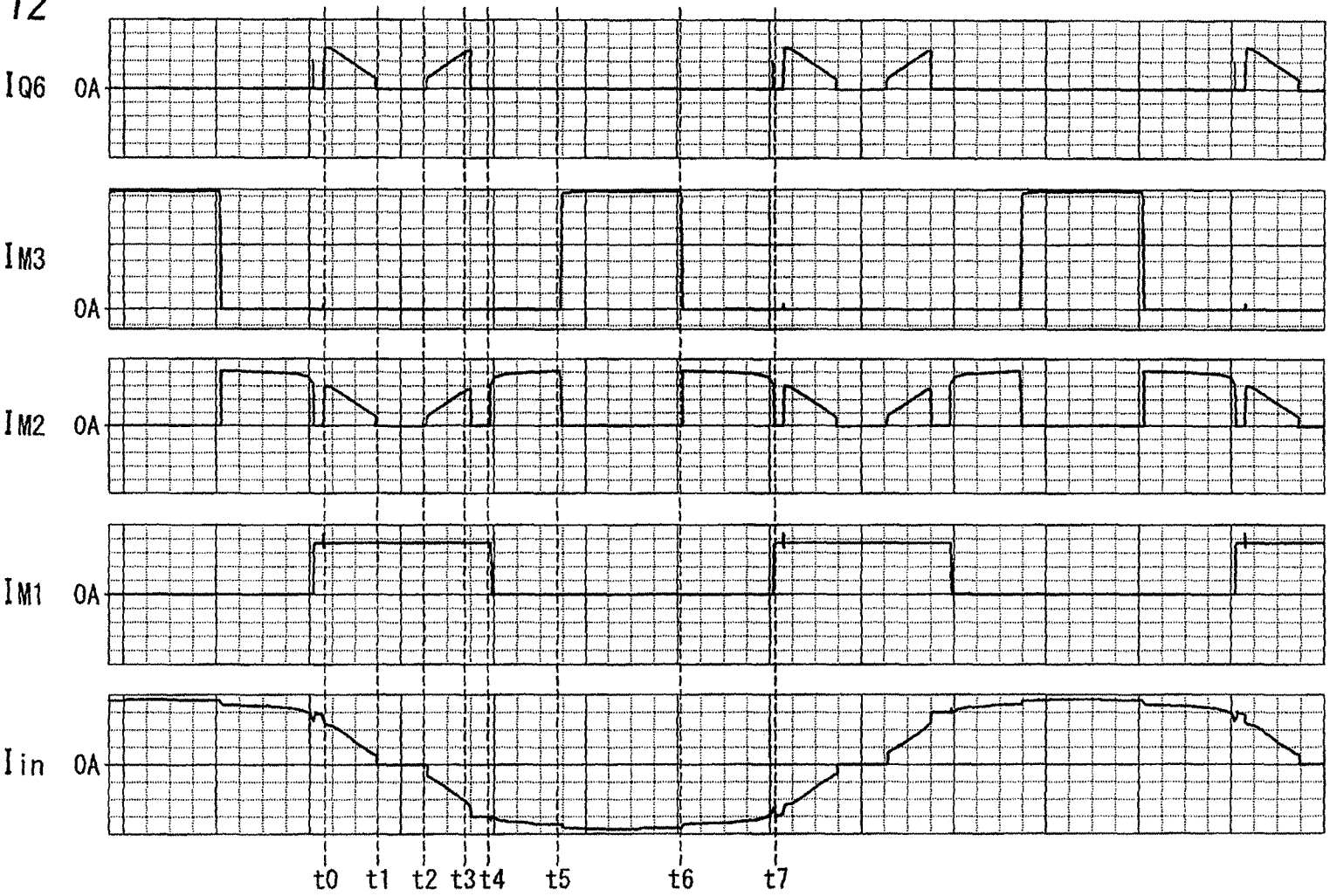
FIG. 12 is a time chart for describing operations of the lighting device and the illumination device according to Embodiment 5.

FIG. 12 shows a time chart (waveform) of a current (emitter current) $I_{Q6}$ of the first switch element Q6, drain currents $I_{M1}$, $I_{M2}$ and $I_{M3}$ of the respective transistors M1, M2 and M3, and the input current $I_{in}$.

Since the operations in the first mode, the second mode, and the third mode are in common with the Embodiment 1, description thereof will be omitted. When the output voltage of the rectifier circuit 10 becomes less than the voltage $V_{C0}$ across the capacitor C0 (time t=t0), the lighting device 1 shifts from the first mode to the fourth mode and starts discharging of the capacitor C0. The discharge current of the capacitor C0 flows in a path that passes from the capacitor C0 through the second rectifier element D2, the first light source portion 2A, the first current control circuit 11, the resistor R99, the third rectifier element D3, and the capacitor C0 in this order, and causes the first light source portion 2A to be lighted (refer to the broken line in FIG. 11).

Meanwhile, the second bypass circuit 15 operates as a result of the discharge current flowing in the resistor R99. Due to decrease of the input current $I_{in}$, the second switch element Q7 turns off, and the first switch element Q6 turns on, and as a result the first bypass circuit 14 operates. As a result, the output voltage of the rectifier circuit 10 is applied to a series circuit of the second light source portion 2B and the second current control circuit 13 via the first bypass circuit 14 and the second bypass circuit 15. Then, for a period during which the output voltage of the rectifier circuit 10 exceeds a reference voltage Vf2 of the second light source portion 2B, a current (input current $I_{in}$) flows in a path that passes from the rectifier circuit 10 through the first bypass circuit 14, the second light source portion 2B, the second current control circuit 13, the second bypass circuit 15, and the rectifier circuit 10 in this order (refer to the solid line in FIG. 11). The second light source portion 2B is also lighted with this current.

When the output voltage of the rectifier circuit 10 decreases and becomes less than the reference voltage Vf2 (time t=t1), current supply from the rectifier circuit 10 to the second light source portion 2B and the second current control circuit 13 stops. Note that current supply from the capacitor C0 to the first light source portion 2A and the first current control circuit 11 continues, since the voltage $V_{C0}$ across the capacitor C0 is greater than the reference voltage Vf1 of the first light source portion 2A.

Then, when the output voltage of the rectifier circuit 10 increases again and becomes greater than the reference voltage Vf2 (time t=t2) after passing a zero crossing point, a current is supplied from the rectifier circuit 10 to the second light source portion 2B and the second current control circuit 13 via the first bypass circuit 14 and the second bypass circuit 15.

Furthermore, when the output voltage of the rectifier circuit 10 increases and exceeds the voltage $V_{C0}$ across the capacitor C0 (time t=t3), the lighting device 1 shifts to the first mode from the fourth mode. Thereafter, the lighting device 1 changes the operation mode cyclically in order from the first mode to the second mode, the third mode, the second mode, the first mode, and the fourth mode, in accordance with the change of the output voltage of the rectifier circuit 10.

As described above, since the lighting device 1 of the present embodiment is configured such that a current is supplied from the rectifier circuit 10 to the second light source portion 2B and the second current control circuit 13 even in the fourth mode, a quiescence period of the input current $I_{in}$ can be reduced compared with the lighting device 1 of Embodiment 1. As a result, in the lighting device 1 of the present embodiment, a higher order component of an input current distortion can be reduced compared with the lighting device 1 of Embodiment 1.

Furthermore, since the second light source portion 2B in the lighting device 1 of the present embodiment is lighted even in the fourth mode, the uniformity of light can be improved compared with the lighting device 1 of Embodiment 1.

Figure 13:
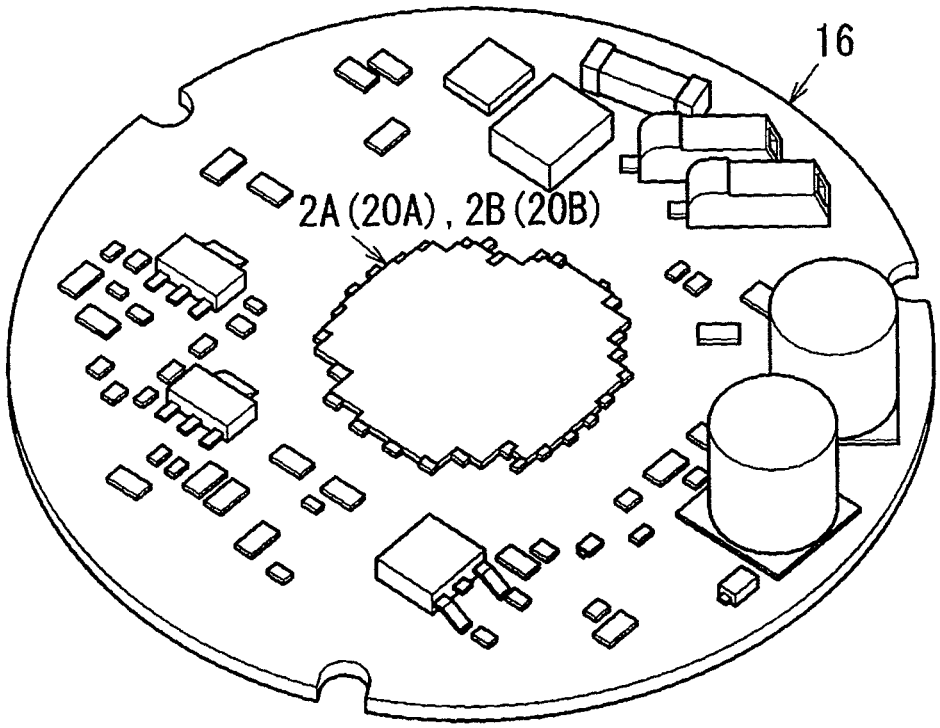
FIG. 13 is a perspective view of a structure of the lighting device and the illumination device according to Embodiment 5.

Incidentally, the lighting device 1 in each of Embodiments 1 to 5 may be integrally configured with the light sources (first light source portion 2A and second light source portion 2B), as shown in FIG. 13. For example, it is preferable that LEDs 20A and 20B are mounted at a central portion of one surface (mounting surface) of a mounting substrate 16 shaped like a disk, and various circuit components that constitute the lighting device 1 are mounted around the LEDs 20A and 20B on the mounting surface. If an illumination device is configured by mounting the light sources and the lighting device 1 on one mounting substrate 16, as described above, the illumination device can be miniaturized compared with a case where the light source and the lighting device 1 are configured separately.

(Embodiment 6)

A lighting fixture according to an embodiment will be described in detail with reference to FIGS. 14A to 14C. The lighting fixture of the present embodiment is preferably configured as a down light that is provided to be buried in a ceiling, as shown in FIG. 14A, for example. The lighting fixture includes a reflector 61 and a fixture body 60 that houses light sources (first light source portion 2A and second light source portion 2B) and a lighting device 1. A plurality of radiation fins 600 are provided in an upper portion of the fixture body 60. A power cable 62 that is led out from the fixture body 60 is electrically connected to an AC power supply 3.

Figure 14C:
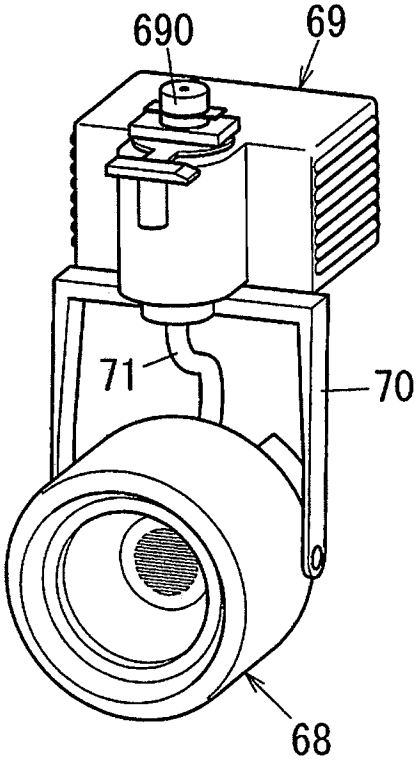
FIGS. 14A to 14C are perspective views of lighting fixtures according to an embodiment.
Figure 14B:
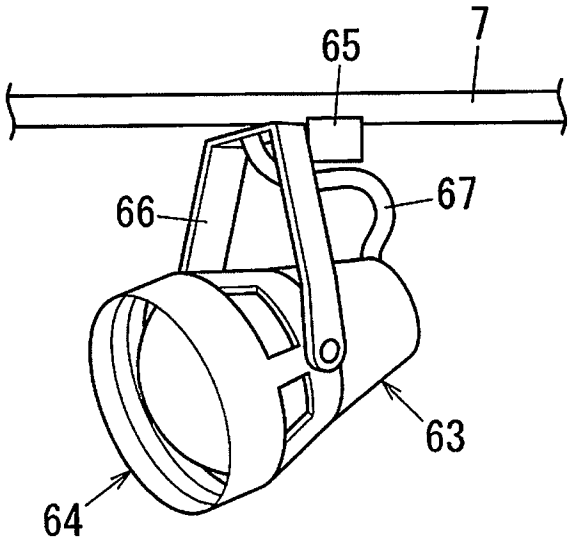
Figure 14A:
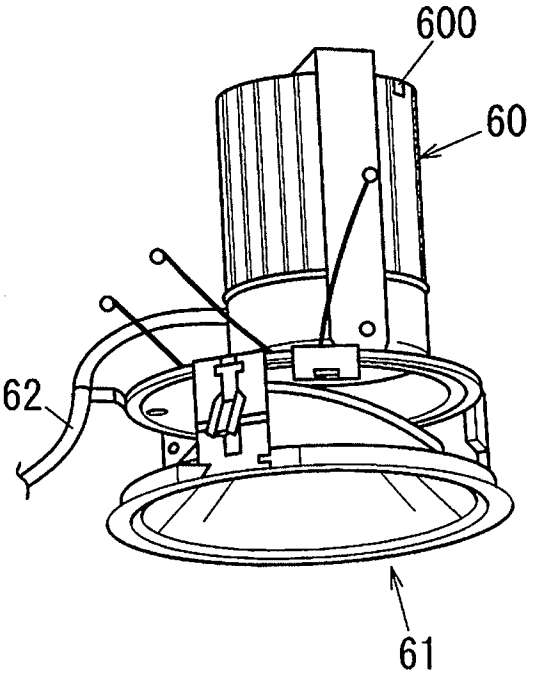

Alternatively, the lighting fixture of the present embodiment may be preferably configured as a spot light to be attached to a wiring duct 7, as shown in FIGS. 14B and 14C. A lighting fixture shown in FIG. 14B includes: a fixture body 63 that houses light sources (first light source portion 2A and second light source portion 2B) and a lighting device 1; a reflector 64; a connector portion 65 that is attached to a wiring duct 7; and an arm portion 66 that couples the connector portion 65 and the fixture body 63. The connector portion 65 and the lighting device 1 are electrically connected via a power cable 67.

On the other hand, a lighting fixture shown in FIG. 14C includes: a fixture body 68 that houses a light source; a box 69 that houses a lighting device 1; a connection portion 70 that connects the fixture body 68 and the box 69; and a power cable 71 that electrically connects the light source and the lighting device 1. Note that a connector portion 690 that is to be electrically and mechanically connected to the wiring duct 7 in a detachable manner is provided on an upper surface of the box 69.

As described above, the lighting fixture of the present embodiment includes the illumination device (first light source portion 2A and lighting device 1) and the fixture body 60 that holds the illumination device.

(Embodiment 7)

Figure 15:
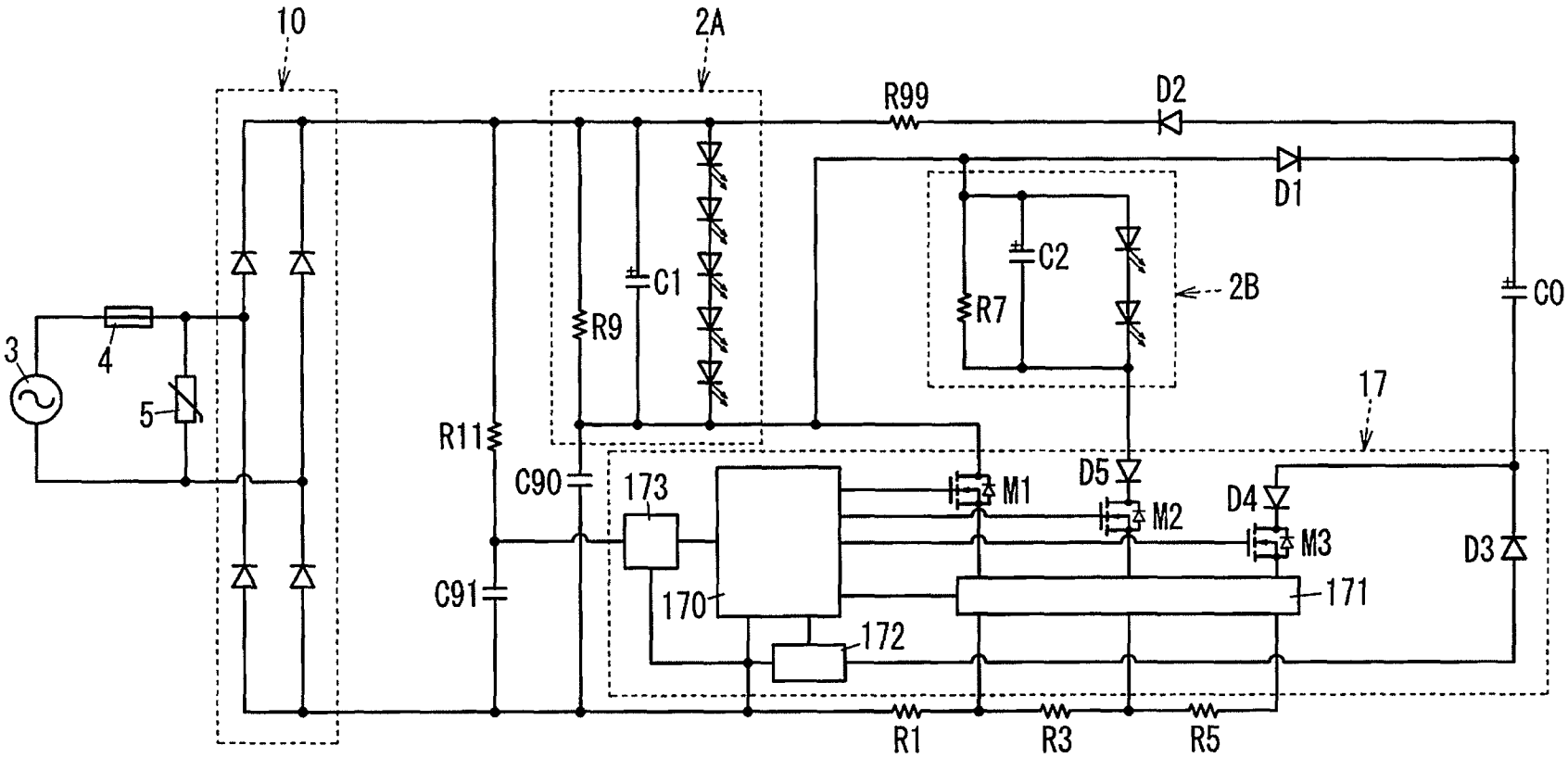
FIG. 15 is a circuit configuration diagram illustrating a lighting device and an illumination device according to Embodiment 7.

It is preferable that, in the lighting device 1 of the present embodiment, a first current control circuit, a second current control circuit and a charging current control circuit are configured by one component as an integrated circuit 17, as shown in FIG. 15.

The integrated circuit 17 is constituted by a current control block 170, a first current detection block 171, a second current detection block 172, a control power supply block 173, transistors M1 to M3, a third rectifier element D3, a fourth rectifier element D4, and the like.

The control power supply block 173 is configured to generate control power from a voltage across a capacitor C91 that is charged via a resistor R11, and to supply the generated control power to the blocks 170, 171, and 172. Note that the control power supply block 173 preferably further includes a temperature sensor, and is configured to stop supply of the control power when an internal temperature of the integrated circuit 17 that is measured by the temperature sensor exceeds an upper limit value.

The first current detection block 171 is configured to detect drain currents $I_{M1}$ to $I_{M3}$ that respectively flow in the transistors M1 to M3 based on voltage drops in external detection resistors R1, R3, and R5. The second current detection block 172 is configured to detect a discharge current that flows in a path that passes from a capacitor C0 through a second rectifier element D2, a resistor R99, a first light source portion 2A, the transistor M1, the first current detection block 171, the resistor R1, the second current detection block 172, the third rectifier element D3, and the capacitor C0 in this order.

The current control block 170 is configured to match the drain currents $I_{M1}$ to $I_{M3}$ detected by the first current detection block 171 to respective target values, that is, control the drain currents $I_{M1}$ to $I_{M3}$ to be constant currents, by adjusting gate voltages of the three transistors M1 to M3.

Figure 16:
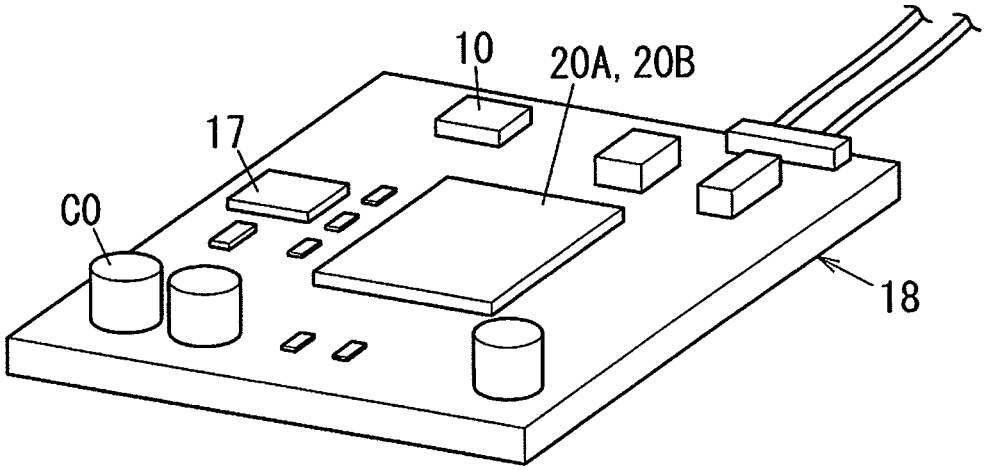
FIG. 16 is a perspective view of a structure of the lighting device and the illumination device according to Embodiment 7.

Here, the lighting device 1 of the present embodiment may be integrally configured with the light sources (first light source portion 2A and second light source portion 2B), as shown in FIG. 16. For example, it is preferable that LEDs 20A and 20B are mounted on one surface (mounting surface) of a mounting substrate 18 shaped like a rectangular plate, and various circuit components, such as an integrated circuit 17, a rectifier circuit 10, and a capacitor C0, that constitute the lighting device 1 are mounted around the LEDs 20A and 20B on the mounting surface. If an illumination device is configured by mounting the light sources and the lighting device 1 on one mounting substrate 18, as described above, the illumination device can be miniaturized compared with a case where the light source and the lighting device 1 are configured separately.

(Embodiment 8)

A lighting device 1 and an illumination device according to Embodiment 8 will be described in detail with reference to FIGS. 17 and 18. Note that the lighting device 1 and the illumination device of the present embodiment are characterized in that a filter circuit 8 is added to the lighting device 1 and the illumination device of Embodiment 1, and the remaining configuration is in common with Embodiment 1. Therefore, constituent elements in common with Embodiment 1 are provided with the same reference numerals, and illustration and description thereof will be omitted as appropriate.

Figure 17:
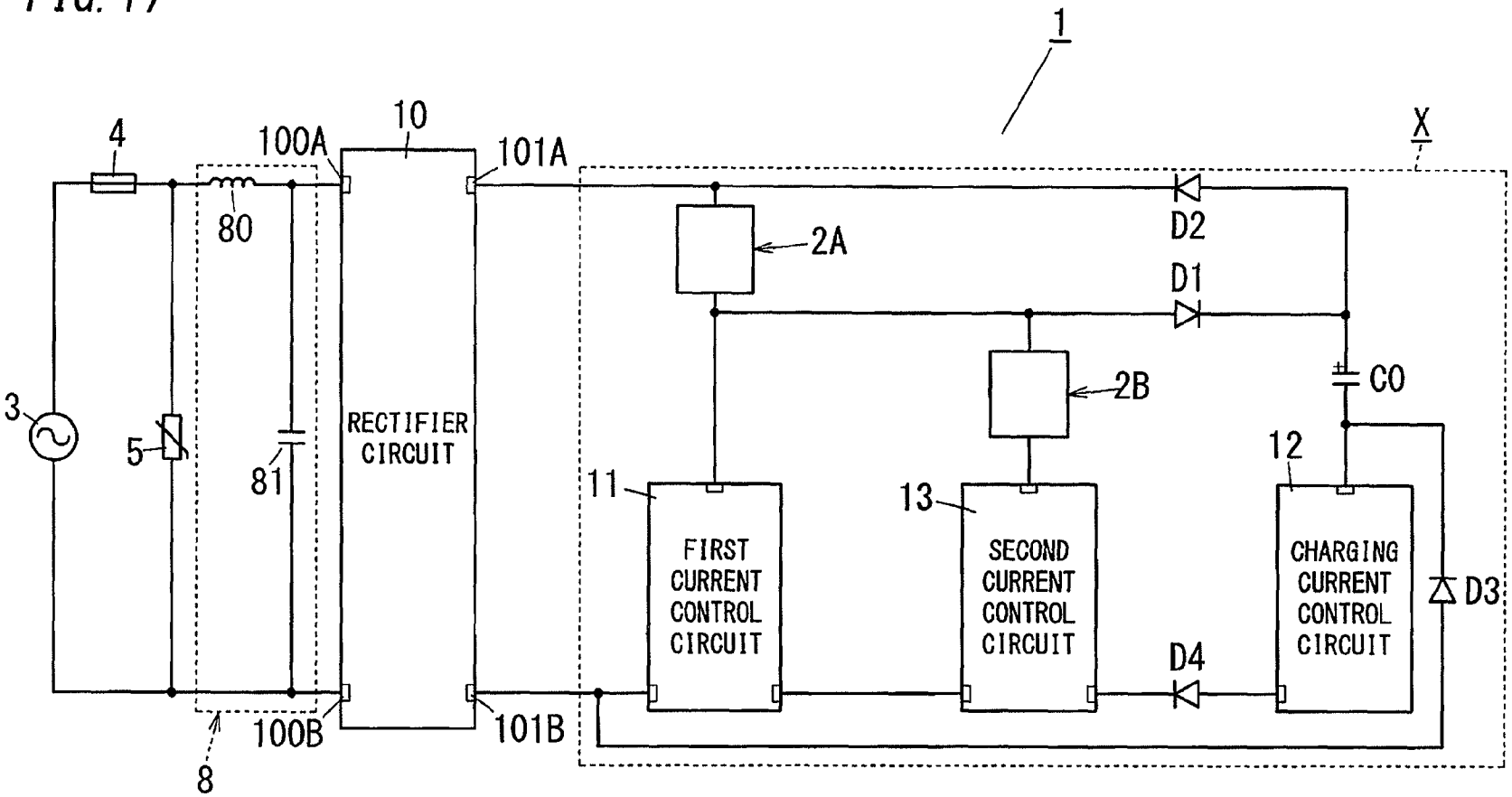
FIG. 17 is a circuit configuration diagram illustrating a lighting device and an illumination device according to Embodiment 8.

A surge absorbing element 5 is electrically connected between input terminals 100A and 100B of a rectifier circuit 10, as shown in FIG. 17. However, a varistor (such as a varistor constituted by a ceramic including zinc oxide as a main component) that is used as the surge absorbing element 5 requires a delay time of approximately 1 μs (microsecond) from an applied voltage (surge voltage) exceeding a threshold voltage until a resistance value decreasing sharply. Therefore, the surge voltage may possibly be applied to a main circuit X (a first light source portion 2A and a first current control circuit 11 and circuits thereafter; the same applies hereinafter) during the delay time. For example, since a lightning surge voltage has a rising time of several μs, the main circuit X can be sufficiently protected by the surge absorbing element 5. However, since a rising time of line noise (conduction noise terminal voltage) generated by an electric motor, a switch, or the like is very short, that is, less than or equal to 10 ns (nanoseconds), the line noise is unlikely to be absorbed by the surge absorbing element 5.

Accordingly, the lighting device 1 of the present embodiment is configured such that a rising time of a surge voltage is lengthened by electrically connecting a filter circuit 8 including a low-pass filter upstream (between the input terminals 100A and 100B) of the rectifier circuit 10. The filter circuit 8 is preferably constituted by an inductor (coil) 80 and a capacitor 81, for example. A first end of the inductor 80 is electrically connected to one input terminal 100A of the rectifier circuit 10, and a second end of the inductor 80 is electrically connected to a connection point of a fuse 4 and the surge absorbing element 5. The capacitor 81 is electrically connected in parallel between the input terminals 100A and 100B of the rectifier circuit 10. Note that the filter circuit 8 may be electrically connected in parallel between the output terminals 101A and 101B of the rectifier circuit 10.

Here, a rated current of the inductor 80 is desirably larger than an input current of the lighting device 1. For example, in the case where a peak value of the input current of the lighting device 1 is 140 mA, it is preferable that the rated current of the inductor 80 is approximately 200 mA. In addition, since a larger current may possibly flow at the moment when a surge voltage is applied, the inductor 80 is preferably an inductance element, such as an open magnetic circuit-type inductance element, that is unlikely to be magnetically saturated. Also, the inductor 80 may be constituted by an inductance element, such as a parasitic inductance (stray inductance) of a print wiring board on which a rectifier circuit 10 is mounted, that does not use a magnetic body.

On the other hand, since the capacitor 81 needs to withstand a current that flows when a surge voltage is applied, the capacitor 81 is preferably constituted by a multilayer ceramic capacitor, a film capacitor, or the like. Note that the capacitor 81 may be configured by a parasitic capacitance of a print wiring board on which the rectifier circuit 10 is mounted.

Figure 18:
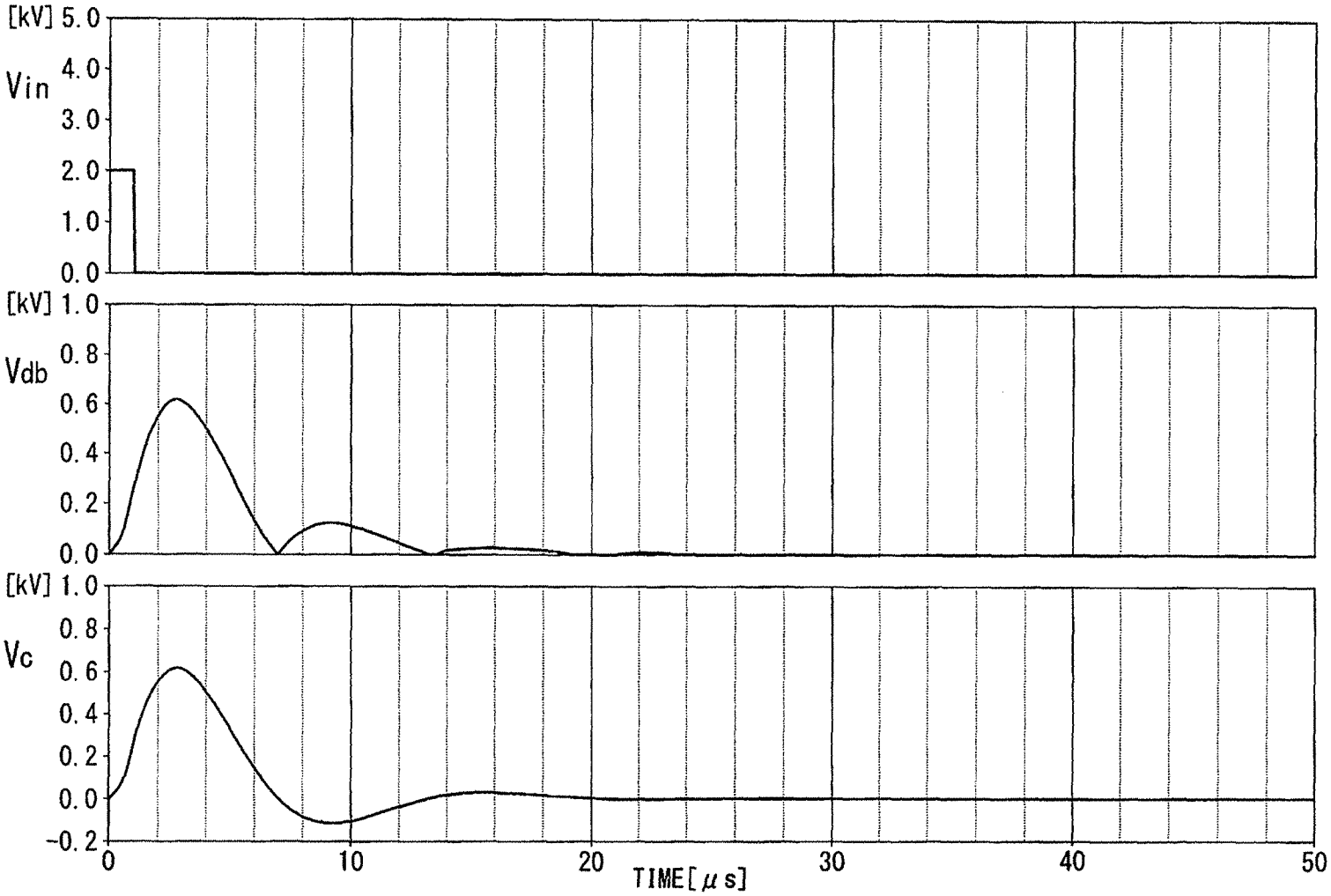
FIG. 18 is a waveform diagram for describing operations of the lighting device and the illumination device according to Embodiment 8.

Here, in the lighting device 1 of the present embodiment, an input voltage Vin from a AC power supply 3 is assumed to have increased to approximately 2 kV (kilovolts) for approximately 2 μs in a situation in which the surge absorbing element 5 is removed, as shown in FIG. 18. Assuming that the inductance value of the inductor 80 is 100 μH (μ henry), and the capacitance value of the capacitor 81 is 22 nF (nano-farad), the time constant τ of the filter circuit 8 will be approximately 1.5 μs, as shown in the following equation.

$$\tau = \{(100\times10^{-6})\times(22\times10^{-9})\}^{1/2}$$
$$\approx 1.5\times10^{-6}$$

That is to say, a voltage Vdb applied between the input terminals 100A and 100B of the rectifier circuit 10 is delayed by approximately 1.5 μs, as shown in FIG. 18. A voltage Vc across the capacitor 81 in the filter circuit 8 increases to approximately 600 V, and then decreases without further increase (refer to FIG. 18). Therefore, although the output voltage of the rectifier circuit 10 also increases to approximately 600 V, if a withstand voltage of the rectifier circuit 10 and a withstand voltage of the main circuit X each is greater than or equal to 600 V, the lighting device 1 is not particularly influenced. In actuality, the surge absorbing element 5 can restrict the input voltage Vin after 1 μs has elapsed. For example, in the case where a varistor having a varistor voltage of 270 V is used as the surge absorbing element 5, the input voltage Vin is limited to approximately 460 V or less. On the other hand, in the case where the filter circuit 8 is not provided, the surge voltage of approximately 2 kV is applied to the main circuit X until the surge absorbing element 5 starts to absorb the surge voltage.

Here, it is possible that an impulse noise may generally increase to approximately 4 kV with a pulse width of 50 ns to 1 μs. In the case where, in the lighting device 1 of the present embodiment, the pulse width of the surge voltage is equal to the time constant of the filter circuit 8, the filter circuit 8 can attenuate the surge voltage to approximately one third thereof. Accordingly, in the case where a surge voltage of 2 kV having a pulse width of 50 ns to 1 μs is assumed to be applied, the main circuit X can be constituted using a circuit element having a breakdown voltage of approximately 600 V, if the time constant of the filter circuit 8 is set to approximately the same as the pulse width of the surge voltage. Also, in the case where a surge voltage of 4 kV having a pulse width of 1 μs is assumed to be applied, the time constant of the filter circuit 8 needs to be 10 μs or more in order to constitute the main circuit X using a circuit element having a breakdown voltage of approximately 400 V. Note that when the time constant of the filter circuit 8 is increased, the inductor 80 and the capacitor 81 increase in size. Therefore, the time constant is preferably set to a value according to a withstand voltage of the main circuit X and the capability (varistor voltage, for example) of the surge absorbing element 5. Generally, if a varistor constituted by a ceramic including zinc oxide as a main component is used as the surge absorbing element 5, the time constant can be set to less than or equal to 1 μs, and the surge absorbing element 5 can be miniaturized.

As described above, it is preferable that, the lighting device 1 of the present embodiment includes the filter circuit 8 including a low-pass filter, which is electrically connected to at least one of; the side of an input terminal (input terminals 100A and 100B) of the rectifier circuit 10; and the side of an output terminal (output terminals 101A and 101B) of the rectifier circuit 10.

If the lighting device 1 and the illumination device of the present embodiment is configured as described above, surge protection by the surge absorbing element 5 can be performed against impulse noise, which is difficult to protect against with only the surge absorbing element 5, by rounding the rising waveform thereof with the filter circuit 8.

(Embodiment 9)

A lighting device 1 and an illumination device according to Embodiment 9 will be described in detail, with reference to FIG. 19. Note that the lighting device 1 and the illumination device of the present embodiment include a configuration in common with the lighting device 1 and the illumination device of Embodiment 8, except for the configuration of a filter circuit 8. Therefore, constituent elements in common with Embodiment 8 are provided with the same reference numerals, and illustration and description thereof will be omitted as appropriate.

Figure 19:
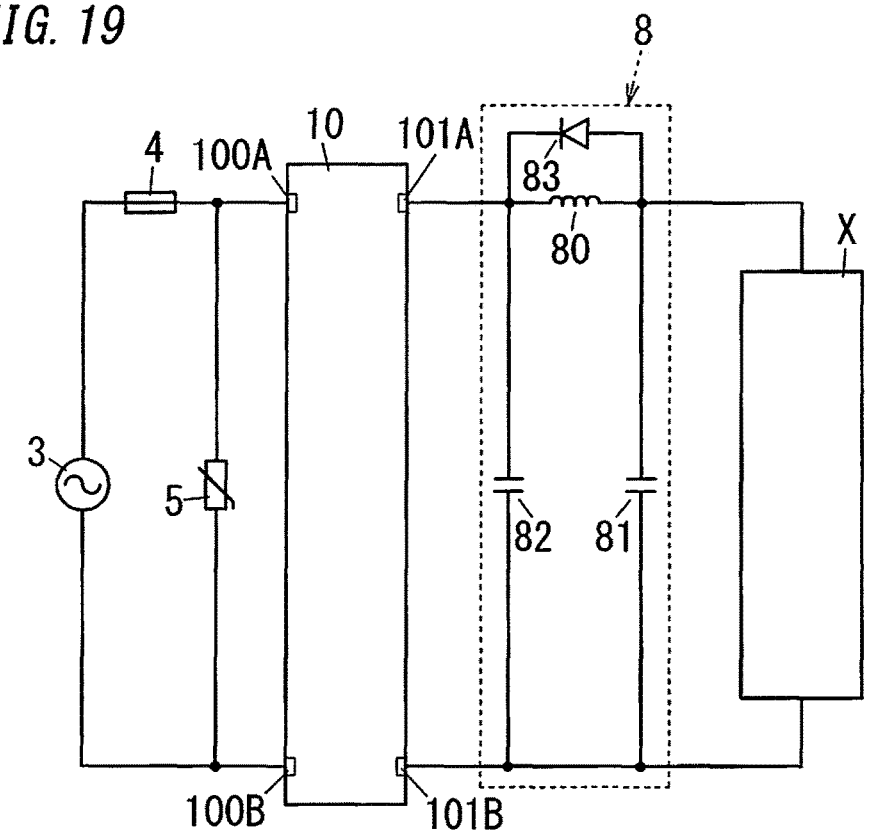
FIG. 19 is a circuit configuration diagram illustrating a lighting device and an illumination device according to Embodiment 9.

The filter circuit 8 in the present embodiment includes a second capacitor 82 and a diode 83 in addition to an inductor 80 and a capacitor 81 (first capacitor), and is provided on an output side of the rectifier circuit 10, as shown in FIG. 19. The second capacitor 82 is electrically connected to an output terminal 101A of the rectifier circuit 10 on a high potential side thereof. A parallel circuit of the inductor 80 and the diode 83 is inserted between the output terminal 101A of the rectifier circuit 10 on the high potential side and a main circuit X. The first capacitor 81 is electrically connected in parallel to a series circuit of the inductor 80 and the second capacitor 82. The inductor 80 and the first capacitor 81 constitute a low-pass filter. The second capacitor 82 functions as an overvoltage protection element of the rectifier circuit 10. A capacitor having a capacitance of 100 nF or less is preferably used as the second capacitor 82.

In the lighting device 1 and the illumination device of the present embodiment also, surge protection by the surge absorbing element 5 can be performed against impulse noise by rounding the rising waveform thereof with the low-pass filter constituted by the inductor 80 and the first capacitor 81. Here, in the lighting device 1 and the illumination device of Embodiment 8, a counter-electromotive force that is generated in the inductor 80 after the impulse noise attenuates may possibly apply stress to the main circuit X. In contrast, the lighting device 1 and the illumination device of the present embodiment are configured such that the diode 83 that is electrically connected in parallel to the inductor 80 is made conductive when the counter-electromotive force is generated in the inductor 80. Then, since a current that flows in a closed circuit of the inductor 80 and the diode 83 (in order from the inductor 80 to the diode 83 and the inductor 80) is converted to heat (Joule heat generated by a resistor component of a coil of the inductor 80), the main circuit X is unlikely to be subjected to stress in the lighting device 1 and the illumination device of the present embodiment.

Also, since the filter circuit 8 is provided between the output terminals 101A and 101B of the rectifier circuit 10 in the lighting device 1 and the illumination device of the present embodiment, the polarity of a voltage that is applied to the filter circuit 8 is fixed. Accordingly, a capacitor for DC, which is relatively low cost, can be used as each of the first capacitor 81 and the second capacitor 82, instead of a capacitor for AC, which is relatively expensive. As a result, reduction of the production cost and miniaturization can be realized in the lighting device 1 and the illumination device of the present embodiment, compared with the lighting device 1 and the illumination device of Embodiment 8.

(Embodiment 10)

A lighting device 1 and an illumination device according to Embodiment 10 will be described in detail, with reference to FIG. 20. Note that the lighting device 1 and the illumination device of the present embodiment include a configuration in common with the lighting device 1 and the illumination device of Embodiment 9, except for the configuration of a filter circuit 8. Therefore, constituent elements in common with Embodiment 9 are provided with the same reference numerals, and illustration and description thereof will be omitted as appropriate.

Figure 20:
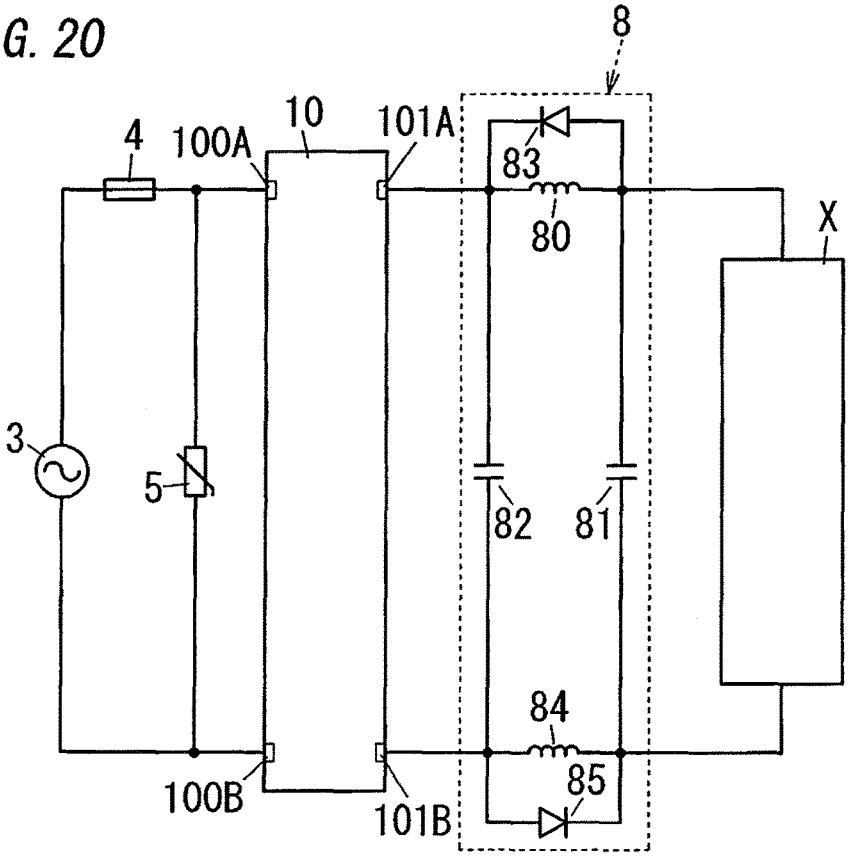
FIG. 20 is a circuit configuration diagram illustrating a lighting device and an illumination device according to Embodiment 10.

The filter circuit 8 in the present embodiment includes a low-pass filter constituted by a second inductor 84 and a second capacitor 82 in addition to an inductor 80 (first inductor) and a capacitor 81 (first capacitor), as shown in FIG. 20. Furthermore, a second diode 85 is electrically connected in parallel to the second inductor 84 in the filter circuit 8. That is, the filter circuit 8 includes: a first low-pass filter formed by the first inductor 80 and the first capacitor 81; and a second low-pass filter formed by the second inductor 84 and the second capacitor 82. The first and second low-pass filters are electrically connected in series. Accordingly, if the time constant of the filter circuit 8 is the same as the time constant of the filter circuit 8 in Embodiment 9, the inductance value of each of the first inductor 80 and the second inductor 84 can be made smaller than the inductance value of the inductor 80 in the filter circuit 8 in Embodiment 9. Similarly, the capacitance value of each of the first capacitor 81 and the second capacitor 82 can be made smaller than the capacitance value of the first capacitor 81 in the filter circuit 8 in Embodiment 9. As a result, since a relatively small component can be used as each of circuit elements that constitute the filter circuit 8, the lighting device 1 and the illumination device of the present embodiment can be made thinner than the lighting device 1 and the illumination device of Embodiment 9, even though the number of the circuit elements constituting the filter circuit 8 increases. Note that, in the lighting device 1 and the illumination device of the present embodiment, similarly to Embodiment 8, a low-pass filter formed by an inductor and a capacitor may be provided between input terminals 100A and 100B of the rectifier circuit 10, and the filter circuit 8 may be constituted by thee low-pass filters in total. If the lighting device 1 and the illumination device of the present embodiment is configured as describe above, the filter circuit 8 can be constituted by even smaller circuit elements.

(Embodiment 11)

Figure 21:
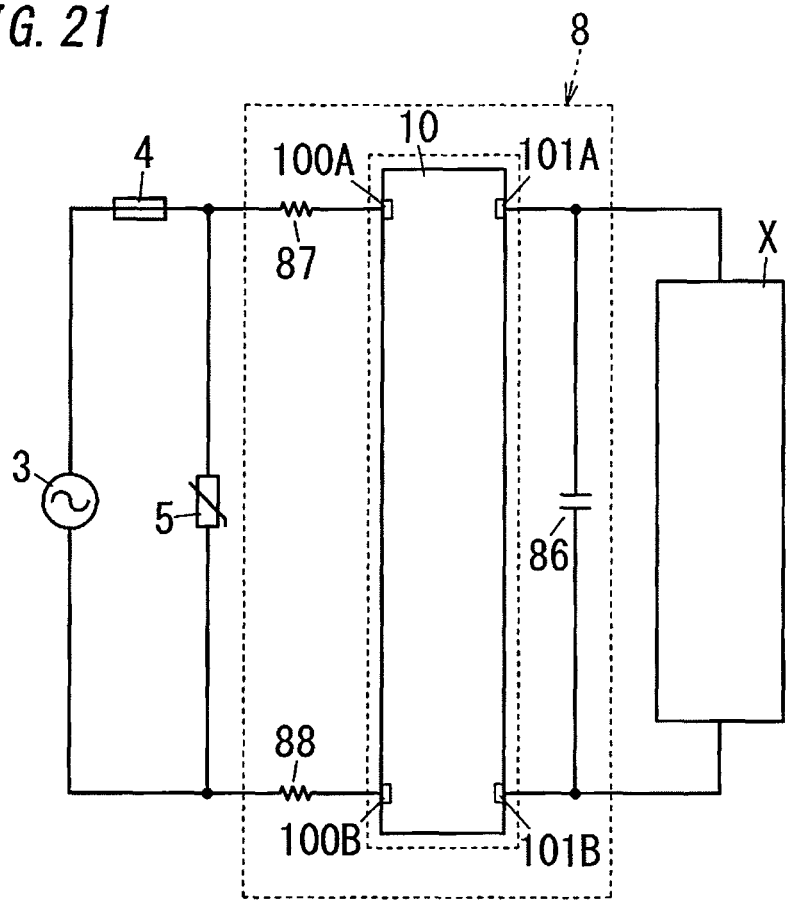
FIG. 21 is a circuit configuration diagram illustrating a lighting device and an illumination device according to Embodiment 11.

A lighting device 1 and an illumination device according to Embodiment 11 will be described in detail, with reference to FIG. 21. Note that the lighting device 1 and the illumination device of the present embodiment include a configuration in common with the lighting device 1 and the illumination device of Embodiment 8, except for the configuration of a filter circuit 8. Therefore, constituent elements in common with Embodiment 8 are provided with the same reference numerals, and illustration and description thereof will be omitted as appropriate.

A filter circuit 8 in the present embodiment includes a low-pass filter (RC integrating circuit) formed by a capacitor 86 and resistors 87 and 88. The capacitor 86 is electrically connected in parallel to a rectifier circuit 10 between output terminals 101A and 101B thereof. A first end of the resistor 87 is electrically connected to an input terminal 100A of the rectifier circuit 10, and a second end of the resistor 87 is electrically connected to a connection point of a fuse 4 and a surge absorbing element 5. A first end of the resistor 88 is electrically connected to an input terminal 100B of the rectifier circuit 10, and a second end of the resistor 88 is electrically connected to a connection point of an AC power supply 3 and the surge absorbing element 5. Note that the resistors 87 and 88 may be electrically connected to the output terminals 101A and 101B of the rectifier circuit 10.

The time constant of the filter circuit 8 can be represented by a product of the capacitance value of the capacitor 86 and the resistance values of the resistors 87 and 88. For example, in the case where the rated value of an input voltage Vin is 200V and the rated value of an input current is less than 50 mA, in order to control the time constant $\tau$ to be 1 μs, the capacitance value of the capacitor 86 needs to be 2 nF and the resistance values of the resistors 87 and 88 need to be 50Ω and 0Ω, respectively. Alternatively, the resistance value of each of the resistors 87 and 88 may be 25Ω. In this case, loss (total value) in the resistors 87 and 88 in a steady state is approximately 0.1 watts. Accordingly, in the lighting device 1 and the illumination device of the present embodiment, reduction in size and cost can be realized compared with a low-pass filter constituted by an inductor 80 and a capacitor 81, even though a loss of approximately 1% with respect to input electric power of 10 watts occurs.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

The invention claimed is:

1. A lighting device, comprising:

a rectifier circuit configured to rectify a sine wave AC voltage inputted between a pair of input terminals of the rectifier circuit, and output a pulsating voltage from between a pair of output terminals of the rectifier circuit;

a current control circuit electrically connected in series to a light source between the pair of output terminals, and configured to control a current flowing in the light source such that the current does not exceed a predetermined value;

a storage element;

a charging current control circuit configured to control a charging current that flows to the storage element, the storage element being electrically connected in series to the charging current control circuit between two ends of the current control circuit;

a first rectifier element that is for causing the charging current to flow to the storage element via the light source and not via the current control circuit;

a second rectifier element that is for causing a discharge current that is discharged from the storage element to flow in the light source; and a third rectifier element that is for causing the discharge current to flow bypassing the charging current control circuit.

2. The lighting device according to claim 1 further comprising a second current control circuit, in addition to a first current control circuit as the current control circuit, wherein the second current control circuit is electrically connected in series to a second light source between the two ends of the current control circuit, which is different from a first light source as the light source, the second current control circuit being configured to control a current flowing in the second light source such that the current flowing in the second light source does not exceed a second predetermined value, which is equal to or different from a first predetermined value as the predetermined value.

3. The lighting device according to claim 2, wherein the second current control circuit is configured to not control the current flowing in the second light source for a period during which the charging current flows to the storage element.

4. The lighting device according to claim 2, wherein the current control circuit is configured to not control the current flowing in the light source for a period during which the charging current flows to the storage element.

5. The lighting device according to claim 4, wherein the second current control circuit is configured to not control the current flowing in the second light source for a period during which the charging current flows to the storage element.

6. The lighting device according to claim 1, wherein the current control circuit is configured to not control the current flowing in the light source for a period during which the charging current flows to the storage element.

7. The lighting device according to claim 6, wherein the second current control circuit is configured to not control the current flowing in the second light source for a period during which the charging current flows to the storage element.

8. The lighting device according to claim 1, wherein the charging current control circuit is configured to control the charging current to be larger than the predetermined value of the current control circuit.

9. The lighting device according to claim 1, wherein the current control circuit is configured to not control the discharge current to be the predetermined value.

10. The lighting device according to claim 1, further comprising a current-limiting element that is provided in a path in which the discharge current flows.

11. The lighting device according to claim 1, further comprising a filter circuit including a low-pass filter, which is electrically connected to at least one of a side of the input terminal of the rectifier circuit and a side of the output terminal of the rectifier circuit.

12. An illumination device comprising:

one or more light sources; and the lighting device according to claim 1, the one or more light sources including one or more solid-state light-emitting elements.

13. The illumination device according to claim 12, wherein a light source, which is electrically connected in series to the current control circuit, of the one or more light sources is configured to emit light in a case where a voltage that is not lower than a reference voltage is applied, and the reference voltage is less than or equal to half of a peak value of the pulsating voltage.

14. A lighting fixture comprising:

the illumination device according to claim 12; and a fixture body that holds the illumination device.

* * * * *